US009010008B2

(12) United States Patent
Hovey

(10) Patent No.: US 9,010,008 B2
(45) Date of Patent: Apr. 21, 2015

(54) FIREARM HANDGRIP ADAPTER

(76) Inventor: David C. Hovey, Tuckahoe, NY (US)

( * ) Notice: Subject to any disclaimer, the term of this patent is extended or adjusted under 35 U.S.C. 154(b) by 219 days.

(21) Appl. No.: 13/526,909

(22) Filed: Jun. 19, 2012

(65) Prior Publication Data

US 2013/0333263 A1 Dec. 19, 2013

(51) Int. Cl.
*F41C 23/00* (2006.01)
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16
USPC ..... 42/71.01, 71.02, 72, 73, 90; 89/1.42
See application file for complete search history.

(56) References Cited

U.S. PATENT DOCUMENTS 2,386,802 A 10/1945 Johnson, Jr.
2,826,848 A 3/1958 Davies
2,933,843 A 4/1960 McFeeter
3,623,257 A 11/1971 Ray
6,658,781 B1 12/2003 Bowen
6,901,691 B1 6/2005 Little
7,121,034 B2 10/2006 Keng
7,191,557 B2 3/2007 Gablowski
7,243,454 B1 7/2007 Cahill
7,322,142 B1 * 1/2008 Leung ..... 42/71.01
7,552,557 B1 * 6/2009 Mabry ..... 42/72
7,559,167 B1 7/2009 Moody et al.
7,578,089 B1 8/2009 Griffin
7,614,174 B1 11/2009 Beltz
7,665,239 B1 2/2010 Moody et al.
7,665,241 B2 2/2010 Oz
7,698,847 B2 4/2010 Griffin
7,712,241 B2 5/2010 Teetzel et al.
7,793,454 B1 9/2010 Beltz
7,900,390 B2 3/2011 Moody et al.
7,941,960 B2 5/2011 Matthews et al.
8,068,992 B2 * 11/2011 Palais et al. ..... 702/19
8,601,734 B1 * 12/2013 Hopkins et al. ..... 42/73
2005/0241206 A1 11/2005 Teetzel
2006/0191183 A1 8/2006 Griffin
2008/0010890 A1 1/2008 Vice
2009/0056192 A1 3/2009 Oz
2009/0193702 A1 8/2009 Lin
2009/0313873 A1 * 12/2009 Roth ..... 42/72
2010/0122484 A1 5/2010 Moody et al.
2010/0132239 A1 6/2010 Moody et al.
2010/0146836 A1 6/2010 Moody et al.
2011/0179688 A1 * 7/2011 Ash et al. ..... 42/72
2011/0283583 A1 * 11/2011 Freed ..... 42/71.01
2013/0239450 A1 * 9/2013 Michel ..... 42/73
(Continued)

*Primary Examiner* — Gabriel Klein
(74) *Attorney, Agent, or Firm* — Michael E. Zall

(57) ABSTRACT

An apparatus for mounting a handgrip on a forward portion of a firearm. The apparatus includes a mount having an upper portion with a clamp for removably engaging the firearm forward portion. The handgrip, e.g., a pistol handgrip, is symmetrical about a vertical plane passing through the handgrip. The distal portion of the handgrip is offset in the vertical plane from the proximal portion of the handgrip. A pivot means connects the lower portion of the mount to the proximal portion of the handgrip to permit the pivoting of the vertical plane to varying angles on either side of the central axis of the barrel. A lock means locks and unlocks the pivot means to lock the handgrip in position at a selected pivot angle. The apparatus provides the ability of a left handed or right handed shooter to adjust the handgrip to a comfortable position while using the firearm.

1 Claim, 33 Drawing Sheets

FIREARM HANDGRIP ADAPTER

BACKGROUND OF THE INVENTION

1. Field of the Invention

The present invention relates to firearms and specifically to a handgrip apparatus for mounting on a forward portion of a firearm, particularly one having a rail such as a Picatinny rail. More particularly, this invention relates to a vertical style handgrip or pistol grip that is adapted to be mounted on the forward portion of a firearm, preferably on a Picatinny rail, that allows for the selective movement of the handgrip not only along the length of the rail, but for different angular orientations of the handgrip to the rail or barrel to comfortably accommodate a left handed or right handed shooter or a shooter with an atypical hand/arm angulation. The handgrip apparatus permits the handgrip to pivot to an ergonomically acceptable position to accommodate the hand and then be locked in such position prior to use.

2. Description of the Related Art

Referring for general background to FIGS. 1 and 2, most hunting firearms share the same basic design. The forearm portion is positioned along the length and below the rifle barrel 132 and the receiver 122 is positioned in an area just forward of the trigger 123. The firearm then transitions to the shoulder stock 125. This basic design is used today on most traditional style hunting rifles. Such known firearms tend to force the shooter's wrists into unnatural positions, which if continued for extended periods of time, becomes very uncomfortable.

Early style handguns had equally uncomfortable handgrip designs. However, the development of the automatic pistol brought about the relatively comfortable vertical style handgrip or pistol grip. The shooter's hand, when raised from his/her side, remains in a vertical or upright position with the thumb on top. While shooting, such a vertical style handgrip maintains the hand and wrist in a natural, untwisted position. Most such vertical style handgrips or pistol grips are symmetrical about a Vertical Plane passing through the handgrip and are angled forward from the bottom or distal portion, i.e., butt, to the top or proximal portion of the handgrip. The hand and wrist follow this naturally, without becoming contorted and uncomfortable. Because it is a natural position, the shooter can keep his/her hand on the handgrip for longer periods of time, without the hand or wrist becoming stressed and/or pained. This ergonomically correct position allows the shooter to use the handgun for extended periods of time while maintaining control.

This vertical style handgrip or pistol grip eventually transitioned to use on rifles for the shooting (trigger operating) hand, and has become almost standard on military type rifles worldwide. Referring to FIG. 1, the handgrip 121 depicts such a handgrip at the rear of the trigger 123.

For simplicity of discussions herein, the distal portion of the handgrip D can be considered the butt part of the handgrip that is held in the shooter's hand and the proximal portion of the handgrip P is the portion of the handgrip that is attached to the main portion of the firearm.

As is well known to firearm enthusiasts, large caliber and other automatic firearms are often difficult to control when firing, with a lack of control often resulting in muzzle rise which can cause the marksman to shoot wildly or above an intended point of aim or target. It is thus important that the firearm be maintained in a steady, stable position by the shooter to ensure accuracy. Thus, firearms were developed that included a fore or forward handgrip, typically permanently mounted in a fixed position under the barrel of the firearm. The most unattractive handgrips are referred to as "broomsticks," i.e. a simple round tube or modified tube shape mounted perpendicular to the forearm. Such handgrips are useful, but not aesthetically desirable.

The 1921 Thompson submachine gun is an early example of a firearm having fixed in-line front and rear symmetrical vertical style handgrips or pistol grips. However, such a fixed in-line forearm handgrip on this submachine gun is extremely awkward to grasp properly, particularly when a cylindrical drum magazine is attached. Such pistol grips or vertical style handgrips are mounted and locked in one position on the forward portion of a rifle type firearm stock, generally with the Vertical Plane through the handgrip lined up with the Central Axis of the rifle barrel. See for example, FIG. 5 wherein the handgrip 604 is aligned with the center line or Central Axis CA of the firearm. As depicted therein, such "in-line" handgrips are awkward and uncomfortable to grip by the support arm 602 and hand 604 (non-trigger pulling arm and hand) which reach across the chest of the shooter. There are also available handgrips handgrips that include accessory devices, e.g., lasers, rifle supports, that are mounted on the forward portion of a rifle. Such handgrips are also locked in one position, in-line with the Central Axis of the rifle barrel.

In order to overcome the deficiencies associated with a permanently fixed fore handgrip, there has also been developed handgrips which are moveably mounted to the fore end of firearm so as to be capable of movement along a single axis, such axis typically runs beneath the barrel and is parallel to the Central Axis of the barrel of the firearm. Such moveable fore handgrips include a rail mount portion and a handle portion, the rail mount portion being slidably mounted to a rail structure, e.g., Picatinny rail, that is mounted to and extending along the underside of the barrel. With this type structure, typically the rail mount portion has a dove-tailing rail engaging surface preventing the removal of the fore handgrip from the rail. Once such fore handgrip is moved to a desired position upon the corresponding rail, the fore handgrip is typically maintained in such position by the tightening of one or more mechanical fasteners such as set screws which extend through the rail mount portion and into direct engagement with the rail. Such a sliding fore handgrip is capable of sliding only along one axis, i.e., the axis of the rail.

The following is a list of US Published applications and US patents related to this art:

2005/0241206 to Lemire
2006/0191183 to Griffin
2008/0010890 to Vice
2009/0056192 to Oz
2009/0193702 to Lin
2010/0122484 to Moody
2010/0132239 to Moody
2010/0146836 to Moody
U.S. Pat. No. 2,386,802 to Johnson
U.S. Pat. No. 2,826,848 to Davies
U.S. Pat. No. 2,933,843 to McFeeter
U.S. Pat. No. 3,623,257 to Ray
U.S. Pat. No. 6,658,781 to Bowen
U.S. Pat. No. 6,901,691 to Little
U.S. Pat. No. 7,121,034 to Keng
U.S. Pat. No. 7,191,557 to Gablowski
U.S. Pat. No. 7,243,454 to Cahill
U.S. Pat. No. 7,559,167 to Moody
U.S. Pat. No. 7,578,089 to Griffin
U.S. Pat. No. 7,614,174 to Beltz
U.S. Pat. No. 7,665,239 to Moody
U.S. Pat. No. 7,665,241 to Oz
U.S. Pat. No. 7,698,847 to Griffin U.S. Pat. No. 7,712,241 to Teetzel
U.S. Pat. No. 7,793,454 to Beltz
U.S. Pat. No. 7,900,390 to Moody
U.S. Pat. No. 7,941,960 to Matthews The present invention addresses many of the aforementioned deficiencies of known forward mounted handgrips by providing a vertical style handgrip or pistol grip which may be selectively positioned along the length of the barrel or underlying rail and the plane of which is capable of being pivotally positioned at any one of a multiplicity of differing pivot angles relative to the barrel or rail of a firearm to accommodate a wide range of shooter preferences, including left and right handed shooters with varying arm lengths. These, as well as other features and attributes of the present invention will be discussed in more detail below.

OBJECTS AND SUMMARY OF INVENTION

It is an object of this invention to provide a vertical style handgrip or pistol grip which may be selectively positioned along the length of the barrel or underlying rail and is capable of being positioned at any one of a multiplicity of differing angular orientations relative to the barrel or rail of a firearm to accommodate a wide range of shooter preferences, including left and right handed shooters with varying arm lengths.

Another object of this invention is to provide an attachment device adapted to receive various vertical style handgrips or pistol grips produced by both rifle and commercial aftermarket manufacturers that can be removably mounted to the forearm stock of a rifle.

It is another object of this invention is to provide a removably mounted handgrip that is mounted to the fore arm stock that can pivot clockwise or counter clockwise to comfortably accommodate the shooters support arm handgrip, whether left handed or right handed, and be easily locked in position to maintain stability while shooting and subsequently unlocked when it is desired to change the pivot angle of the handgrip.

Another object of this invention is to provide a forward handgrip that ergonomically assists in providing to the support arm enhanced pulling power to increase shoulder stock pressure to the shoulder to provide more control while shooting.

Yet another object of this invention is to provide the shooters aiming and support hand with an ergonomically comfortable handgrip similar to that available for the shooting hand.

Still another object of this invention is to provide any shooter with the capability of installing functionally and esthetically matching handgrips on the forward support portion and rear shooting portion of the firearm that are ergonomically comfortable.

All of the foregoing objects as well as others are achieved by the firearm handgrip adapter of this invention. Broadly, this invention is directed to a handgrip apparatus for mounting a handgrip on a forward portion of a firearm, for example a Picatinny rail under the barrel of an assault rifle. The apparatus includes an elongated mount having an upper portion with a clamp means for removably engaging the forward portion, e.g., rail, of the firearm. The handgrip, e.g., a vertical pistol handgrip, is symmetrical about a Vertical Plane passing through the handgrip. The distal portion of the handgrip, i.e., the "butt" portion that is gripped by the shooter, is offset in the Vertical Plane from the proximal portion of the handgrip. A pivot means connects the lower portion of the mount to the proximal portion of the handgrip to permit the pivoting of the Vertical Plane to varying pivot angles on either side of the Central Axis of the barrel. A lock means locks and unlocks the pivot means to lock the handgrip in a comfortable position at a selected pivot angle. The handgrip apparatus provides the ability of a left handed or right handed shooter to adjust the handgrip to a comfortable position while using the firearm. The handgrip apparatus may also be positioned at varying locations along the length of the forward portion of the firearm.

More specifically, a handgrip apparatus for mounting on a forward portion of a firearm, the firearm having a barrel having a Central Axis and a length of Picatinney rail mounted below the barrel on the forward portion of the firearm parallel to the Central Axis. The handgrip apparatus comprises:

a. an elongated rail mount having an upper portion and a lower portion, the upper portion including a clamp means for removably engaging the rail along a length of the rail;
b. a handgrip, preferably a vertical style handgrip or pistol grip, having a proximal portion and a distal portion, the handgrip being substantially symmetrical about a Vertical Plane passing through the handgrip and suitable for gripping by a shooter's right hand or left hand, the distal portion of the handgrip being offset at an offset pivot angle in the Vertical Plane from the proximal portion;
c. a pivot means for pivotally connecting the lower portion of the rail mount to the proximal portion of the handgrip to permit the pivoting of the Vertical Plane of the handgrip to a pivot angle on either side of the Central Axis; and
d. a lock means for locking and unlocking the pivot means to lock the Vertical Plane of the handgrip at one pivot angle on one side of the Central Axis, unlock the pivot means for pivoting the Vertical Plane of the handgrip to another pivot angle on the other side of the Central Axis, and locking the pivot means at such other pivot angle from the Central Axis.

When the pivot means is locked to provide the Vertical Plane of the handgrip at one pivot angle on one side of the Central Axis, the handgrip is suitable for gripping by a left handed shooter, and when the pivot means is locked to provide the Vertical Plane of the handgrip at another pivot angle on the other side of the Central Axis the handgrip is suitable for gripping by a right handed shooter.

Applicant describes herein numerous embodiments of the invention in conjunction with the drawings, which include variations in the different elements of the invention.

BRIEF DESCRIPTION OF THE DRAWINGS

The novel features believed to be characteristic of the present invention, together with further advantages thereof, will be better understood from the following description considered in connection with the accompanying drawings in which several embodiments of the invention are illustrated by way of example. It is to be expressly understood, however, that the drawings are for the purpose of illustration and description only and are not intended as a definition of the limits of the invention.

For convenience, the Figures are grouped by the Embodiment being depicted, it being understood that each Embodiment may have different specific embodiments of the elements that make up such embodiment.

Embodiment I.

FIG. 1 is a side elevation view of a firearm equipped with a rail structure to which a First Embodiment of the handgrip apparatus of this invention is mounted.

FIG. 2 is an enlarged side elevation view of a firearm equipped with a rail structure to which the First Embodiment of the handgrip apparatus of this invention is mounted.

FIG. 3 is an exploded front/left-side perspective view of the First Embodiment of the handgrip apparatus of this invention shown in increased scale with respect to its representation in FIGS. 1 & 2.

FIG. 4 is a top plan view of a the First Embodiment of the handgrip apparatus of this invention as shown in FIG. 2 with the handgrip pivoted for gripping by the left hand i.e., a right handed shooter.

FIG. 5 is a top plan view of a prior art handgrip being gripped by the left hand.

FIG. 6 is a top plan view of the main body of the First Embodiment of the handgrip apparatus of this invention with the rail mount removed.

FIG. 7 is a bottom plan view of the First Embodiment of the handgrip apparatus of this invention with the handgrip pivoted and locked for gripping by the left hand, i.e., a right handed shooter.

FIG. 8 is a bottom plan view of the First Embodiment of the handgrip apparatus of this invention with the handgrip locked in line or in a neutral position with the rail structure.

FIG. 9 is a bottom plan view the First Embodiment of the handgrip apparatus of this invention with the handgrip pivoted and locked for gripping by the right hand, i.e., a left handed shooter.

FIG. 10 is a top plan view of the First Embodiment of the handgrip apparatus of this invention with cover plate and rail mount removed with the handgrip pivoted and locked for gripping by the right hand, i.e., a left handed shooter.

FIG. 11 is a top plan view of the First Embodiment of the handgrip apparatus of this invention with the cover plate and rail mount removed with the handgrip locked in line with the Central Axis CA or in a neutral position with the rail structure.

FIG. 12 is a top plan view of the First Embodiment of the handgrip apparatus of this invention with cover plate and rail mount removed with the handgrip pivoted and locked for gripping by the left hand i.e., a right handed shooter.

FIG. 13 is a front view of the First Embodiment of the handgrip apparatus of this invention and handgrip mounted to the rail locked in line or in a neutral position with the rail structure.

FIG. 14 is a rear view of the First Embodiment of the handgrip apparatus of this invention and handgrip mounted to the rail (not shown) locked in line with the Central Axis CA or in a neutral position with the rail structure.

FIG. 15 is a cross-sectional view of the First Embodiment of the handgrip apparatus of this invention taken along line 15-15 of FIG. 14 with the locking teeth engaged.

FIG. 16 is a cross-sectional view of the First Embodiment of the handgrip apparatus of this invention taken along line 15-15 of FIG. 14 with the locking teeth dis-engaged.

FIG. 17 is an exploded cross-sectional view of the First Embodiment of the handgrip apparatus of this invention from the left side of the firearm which utilizes a compression type engagement spring.

FIG. 18 is an exploded side view of the assembled First Embodiment of the handgrip apparatus of this invention and handgrip from the left side of the firearm.

Embodiment II.

FIG. 19 is an exploded left side view of the Second Embodiment of the handgrip apparatus of this invention utilizing a horizontal clamping lever 230.

FIG. 19D is a top plan view of the Second Embodiment of the handgrip apparatus of this invention with cover plate and rail mount removed and the handgrip pivoted and locked for gripping by the right hand i.e., a left handed shooter, wherein the horizontal clamping lever 230 is engaged with the locking teeth 220.

Embodiment III.

FIG. 20 is a cross-sectional left side view of the Third Embodiment of the handgrip apparatus of this invention shown in the locked position utilizing a pivot locking mechanism.

FIG. 21 is a cross-sectional left side view of the Third Embodiment of the handgrip apparatus of this invention shown in FIG. 20 utilizing the pivot locking mechanism shown in the unlocked position.

FIG. 22 is a top plan view of the Third Embodiment of the handgrip apparatus of this invention with the cover plate and rail mount removed and the handgrip locked in line with the Central Axis CA or in a neutral position with the rail structure utilizing the pivot locking mechanism with an alternate compression spring configuration.

FIG. 22C is a top plan view of the Third Embodiment of the handgrip apparatus of this invention with the cover plate and rail mount removed and the handgrip in a locked position for gripping by the right hand i.e., a left handed shooter, the pivot locking mechanism with the alternate compression spring configuration being engaged with the locking teeth.

Embodiment IV.

FIG. 23 is a top plan view of the Fourth Embodiment of the handgrip apparatus of this invention with the cover plate and rail mount removed and the handgrip locked in line with the Central Axis CA or in a neutral position with the rail structure utilizing a frictional locking mechanism.

FIG. 24 is a cross-sectional left side view of the Fourth Embodiment of the handgrip apparatus of FIG. 23 utilizing a frictional locking mechanism shown in the locked position.

FIG. 25 a side view of the adjustment knob used in the Fourth Embodiment of the handgrip apparatus depicted in FIGS. 23-24.

FIG. 26 is a top plan view of the upper wedge used in the Fourth Embodiment of the handgrip apparatus depicted in FIGS. 23-24.

FIG. 27 a left side view of upper wedge used in the Fourth Embodiment of the handgrip apparatus depicted in FIGS. 23-24.

FIG. 28 is a right end view of upper wedge used in the Fourth Embodiment of the handgrip apparatus depicted in FIGS. 23-24.

FIG. 29 is a top plan view of the lower wedge used in the Fourth Embodiment of the handgrip apparatus depicted in FIGS. 23-24.

FIG. 30 is a left side view of lower wedge used in the Fourth Embodiment of the handgrip apparatus depicted in FIGS. 23-24.

FIG. 31 is a right end view of lower wedge used in the Fourth Embodiment of the handgrip apparatus depicted in FIGS. 23-24.

Embodiment V.

FIG. 32 is an exploded front/left-side perspective view of the Fifth Embodiment of the handgrip apparatus and handgrip of the present invention using a rotation locking mechanism.

FIG. 33 is an exploded left side view of the Fifth Embodiment of the handgrip apparatus depicted in FIG. 32 of the rail mount.

FIGS. 34-37 are views of the rotating locking mechanism used in the Fifth Embodiment of the handgrip apparatus depicted in FIGS. 32-33.

Embodiment VI.

FIG. 38 is an exploded front/left-side perspective view of the Sixth Embodiment of the handgrip apparatus and handgrip of the present invention using a tension wheel locking mechanism.

FIGS. 39-46 are views of the tension wheel locking mechanism used in the Sixth Embodiment of the handgrip apparatus depicted in FIG. 38.

DETAILED DESCRIPTION OF THE INVENTION

For the sake of convenience, what follows is a description of each embodiment (Embodiments I-VI), the elements for such embodiment and their corresponding numbers.

As previously stated, throughout the application, the distal portion of the handgrip D can be considered the butt part of the handgrip that is held in the shooter's hand and the proximal portion of the handgrip P is the portion of the handgrip that is attached to the main portion of the firearm. Typically, the distal portion D, i.e., the butt, can be removed from the proximal portion P and switched out for aesthetic or functional reasons.

Embodiment I

FIGS. 1-18

Figure 1:
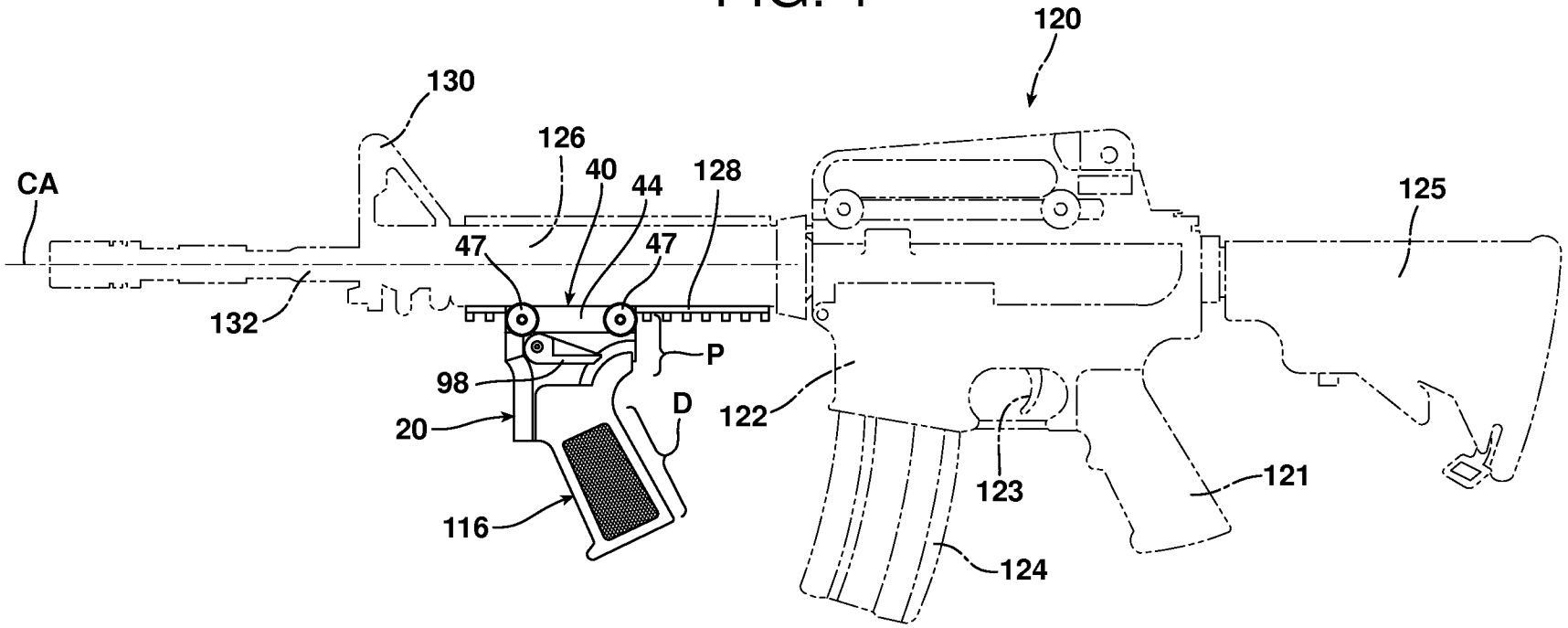
FIGS. 1-18
Figure 2:
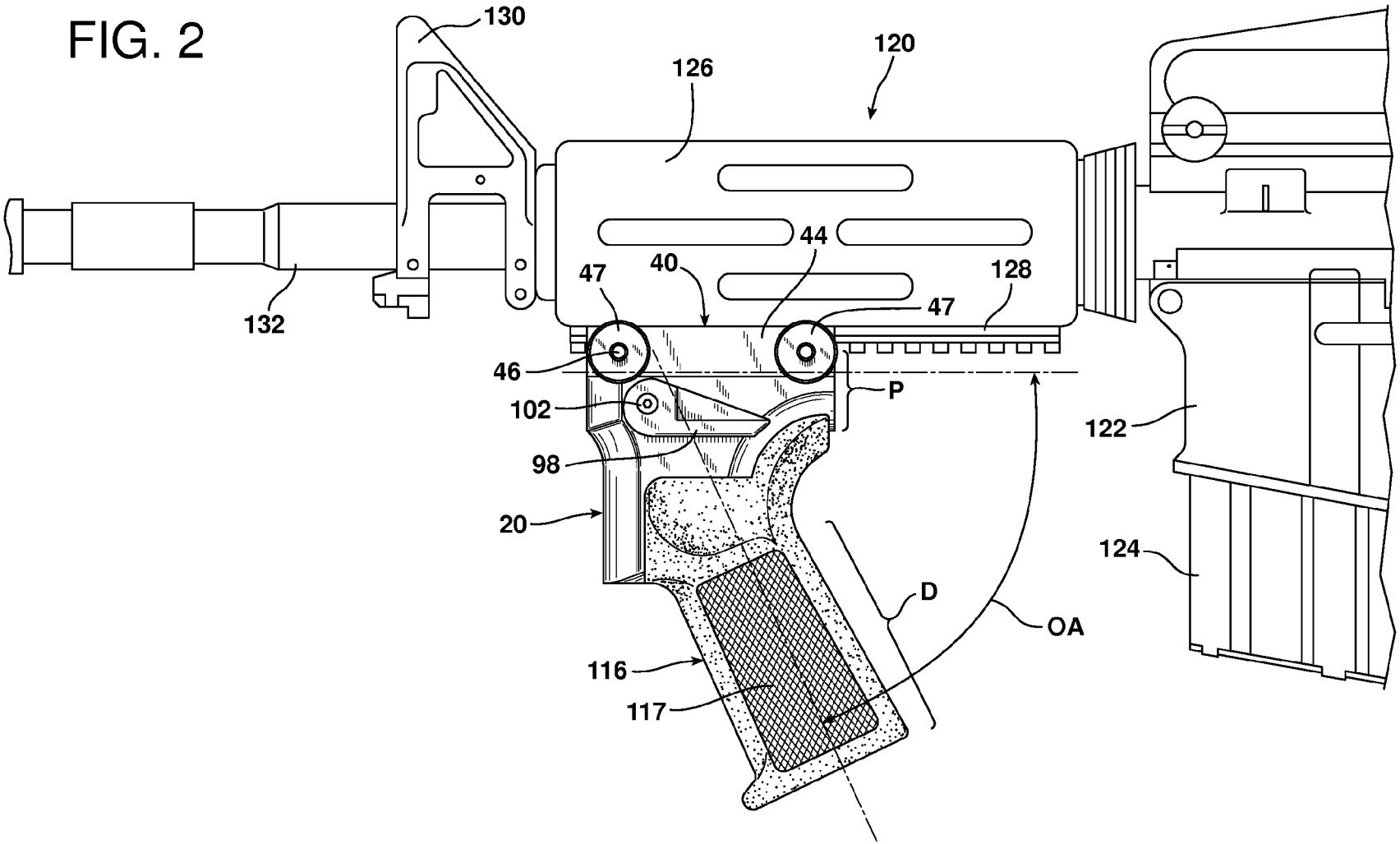

Referring to FIGS. 1 and 2, the handgrip apparatus 20 of this invention is mounted on a forward portion of a firearm 120. The firearm can be any type rifle or military type gun that is fired from the shoulder position with two hands, one being used to fire the weapon 112 (pull the trigger 123) and the other to support the weapon 112. The weapon 112 depicted in FIGS. 1 and 2 is a US Military M4. It should be understood that the handgrip apparatus 20 of this invention may be mounted on any such type firearm.

Figure 13:
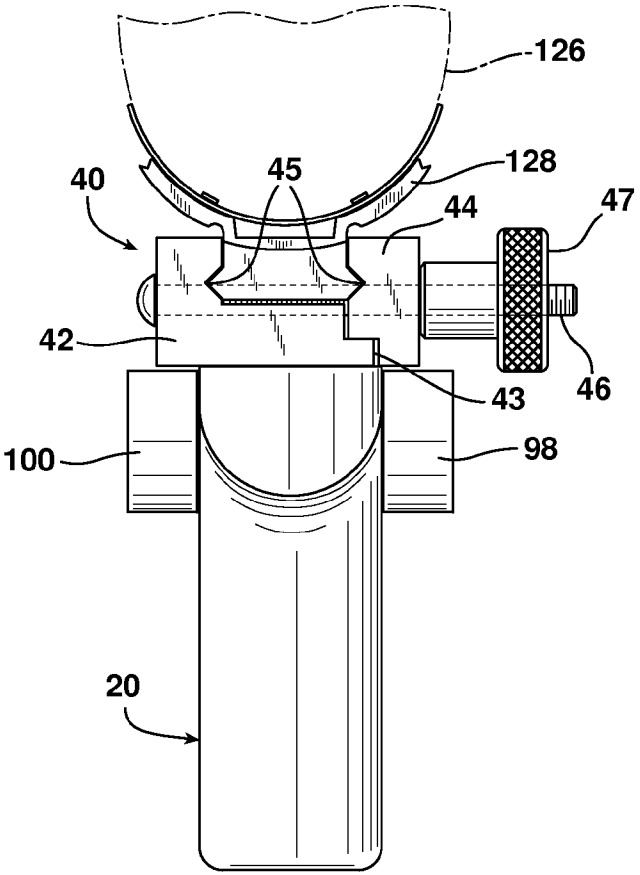

The firearm 120 has a barrel 132 having a Central Axis CA. Although the handgrip apparatus 20 may be mounted on any type firearm or rifle, it is most useful when mounted to a length of rail 128, typically a Picatinny rail, mounted below the barrel 132 on the forward portion of the firearm 120 parallel to the Central Axis CA. Referring to FIGS. 1, 2 and 13, the rail 128 is mounted to the rifle handguard 126.

By the use of the term Picatinny rail, it is meant a bracket used on some firearms in order to provide a standardized mounting platform. Typically, the rail comprises a series of ridges with a T-shaped cross-section interspersed with flat "spacing slots." Alternatively, such rails are known as MIL-STD-1913 rails or STANAG 2324 rails. Such rails are well known in the art. The handgrip apparatus 20 includes an elongated rail mount 40. This is depicted in more detail in FIGS. 3, 4 and 13. In general, the rail mount 40 has an upper portion that removably engages the rail 128. The rail mount 40 can engage the rail 128 anywhere along its length to adjust for arm length and style of shooting.

Referring to FIGS. 2-4 and 13, the upper portion of the rail mount 40 includes a stationary jaw 42 and a clamping jaw 44. The jaws 42, 44 mate along interlocking surfaces 43, e.g., tongue and groove, when the jaws 42, 44 are pressed together. Two tightening screws 46 pass through one side of the jaws 42, 44 and mate with two knurled locking nuts 47 on the other side of the jaws. Tightening the two knurled locking nuts 47, tightens the jaws 42, 44 into direct engagement with each other along surfaces 43 and the rail 128 along dove-tailed rail engaging surfaces 45. The dove-tailed rail engaging surfaces 45 locks the rail mount 40 onto the rail 128 to prevent the removal of the handgrip apparatus 20 from the rail 128. Such rail mount design 40 permits the handgrip apparatus 20 to be selectively positioned along the axis of the rail 128 by merely loosening locking nuts 47, shifting the handgrip apparatus 20 and then tightening the locking nuts 47.

Referring, for example to FIGS. 1-4, the handgrip apparatus 20 further includes a handgrip 116 having a proximal portion P and a distal portion D. Referring to FIGS. 4, 7-12, the handgrip 116 is substantially symmetrical about a Vertical Plane VP passing through the handgrip 116 when the firearm is held in a substantially horizontal plane ready for firing in a conventional manner. Preferably the handgrip 116 is a vertical style handgrip or pistol grip. Such handgrips are well known in the art. In the handgrip 116 depicted the distal portion D, i.e., the "butt" portion of the handgrip 116 has sides 117 with knurling or "checkering" on them for secure gripping.

Figure 3:
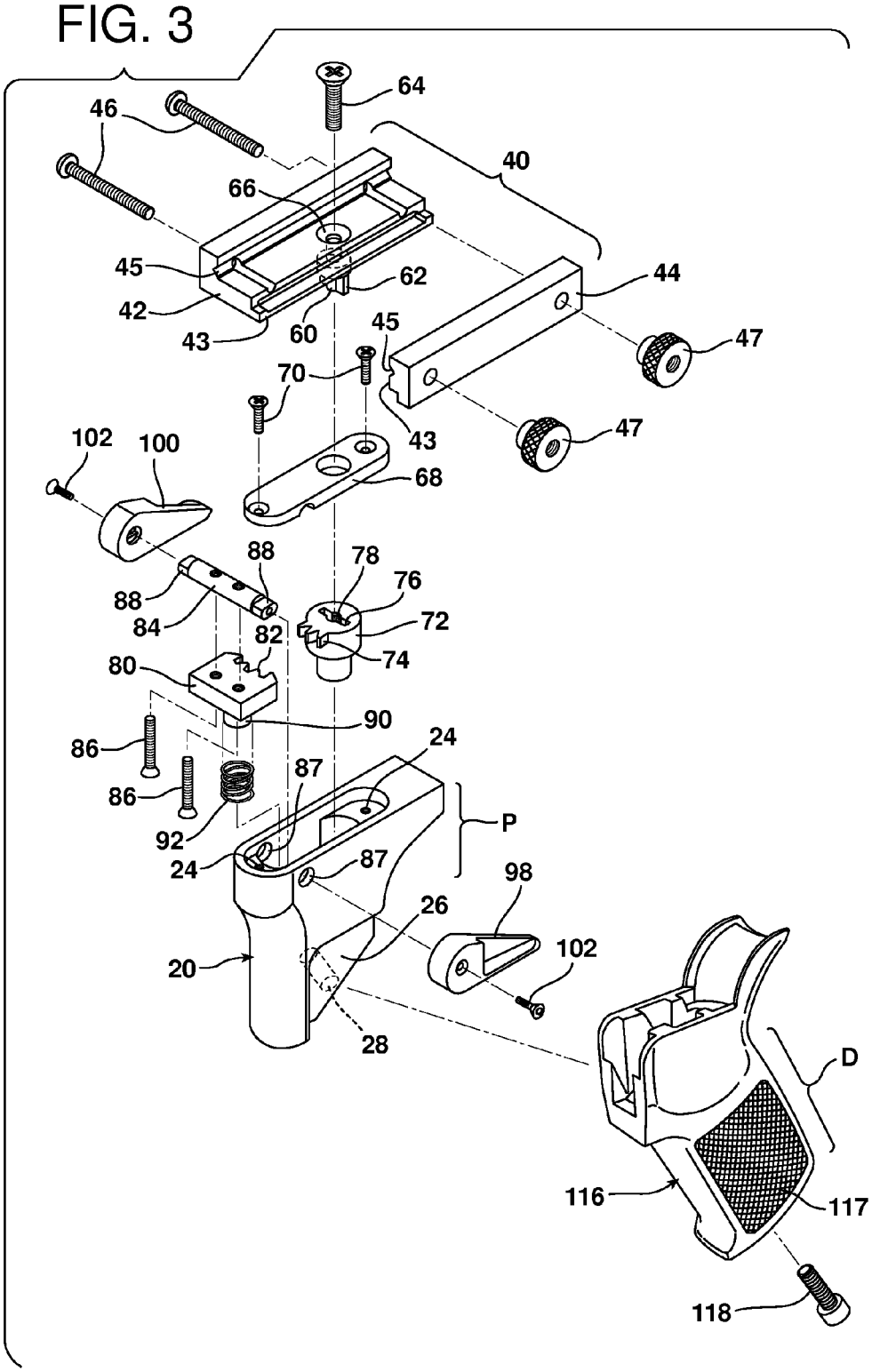
Figure 4:
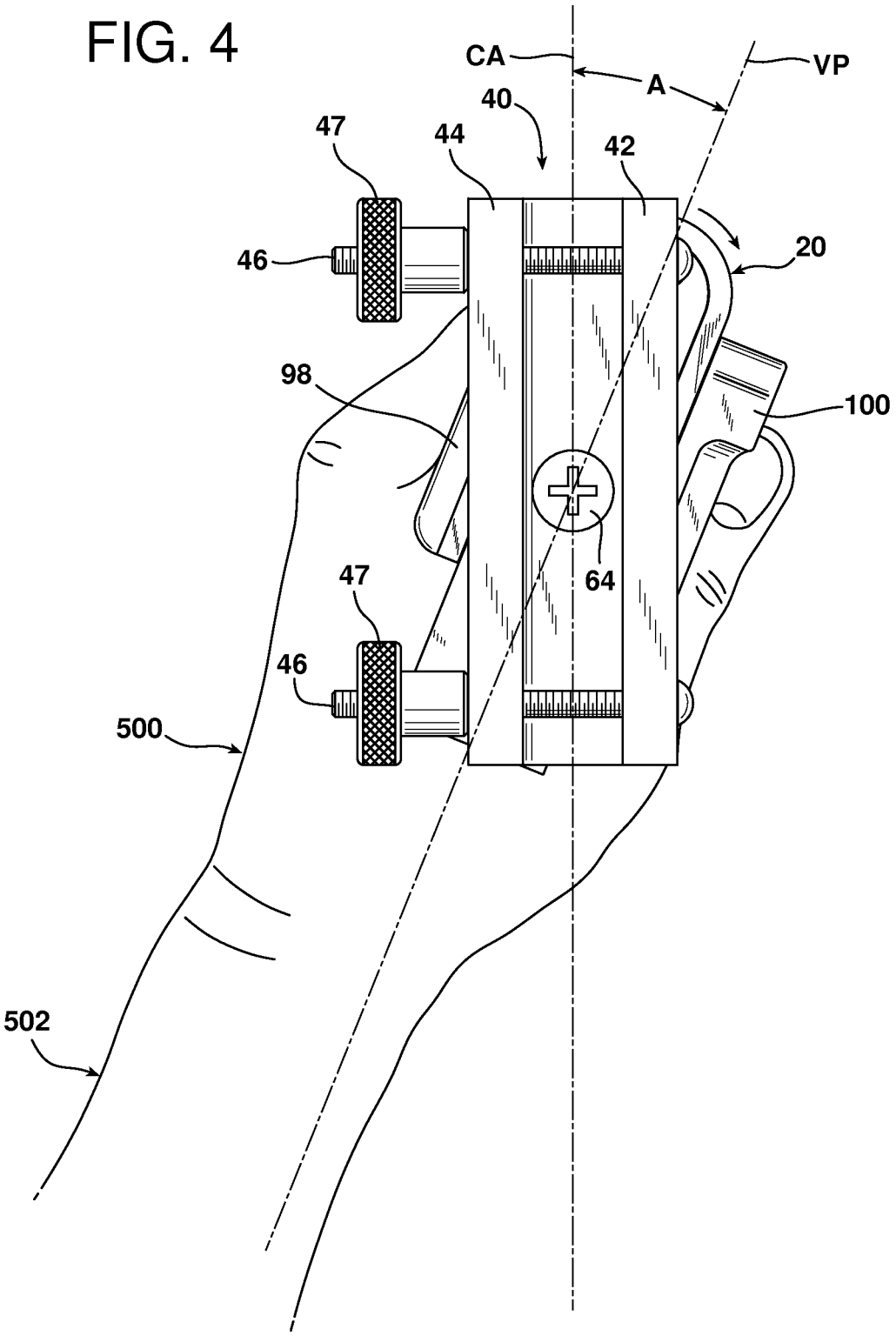
Figure 5:
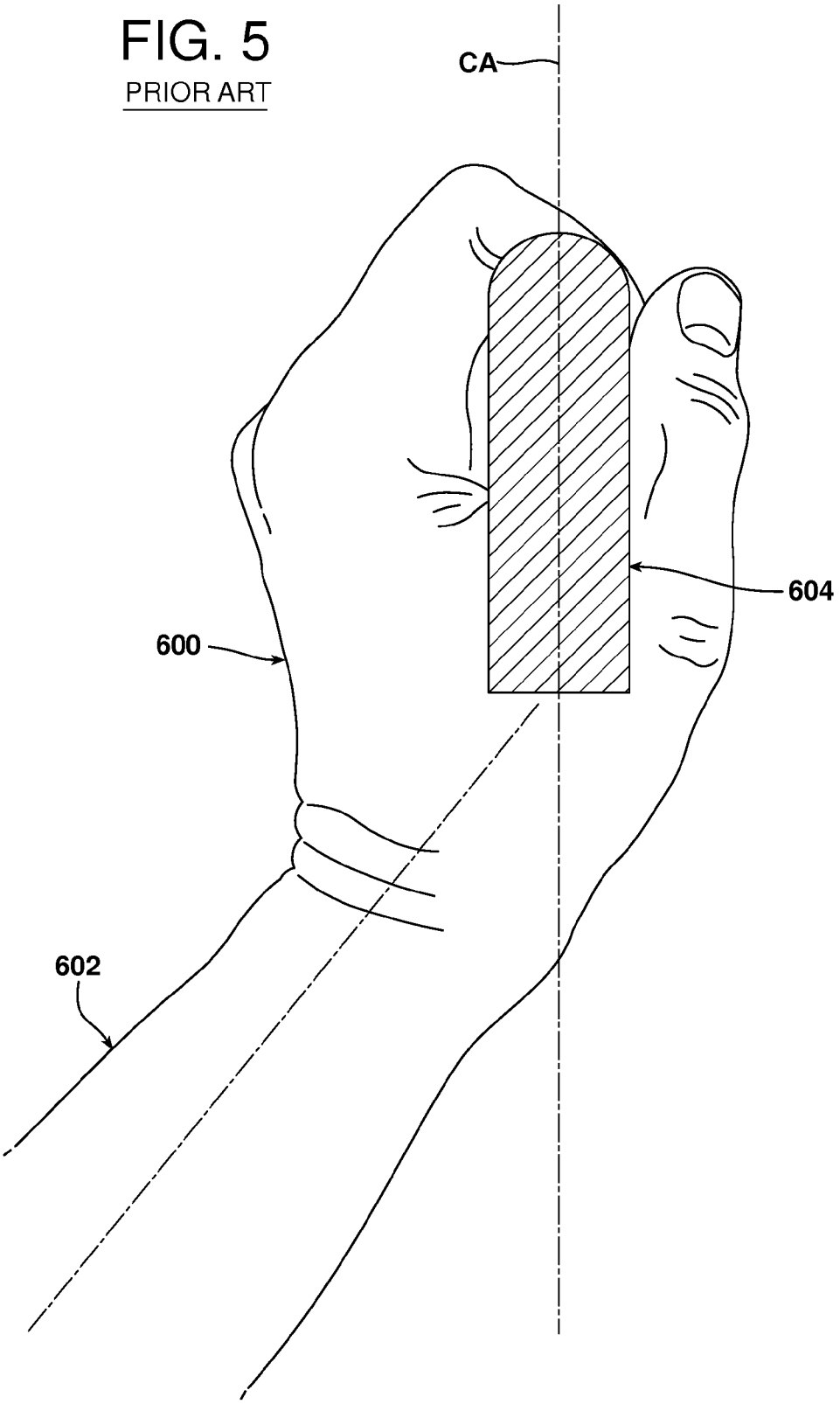
FIG. 5 PRIOR ART
Figure 6:
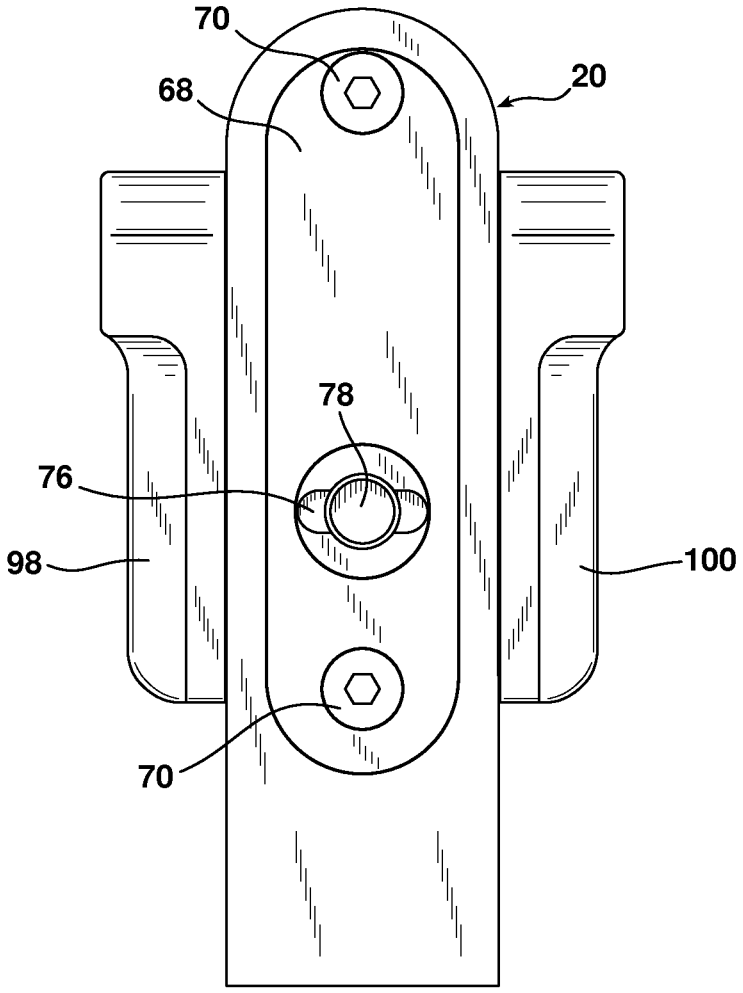
Figure 18:
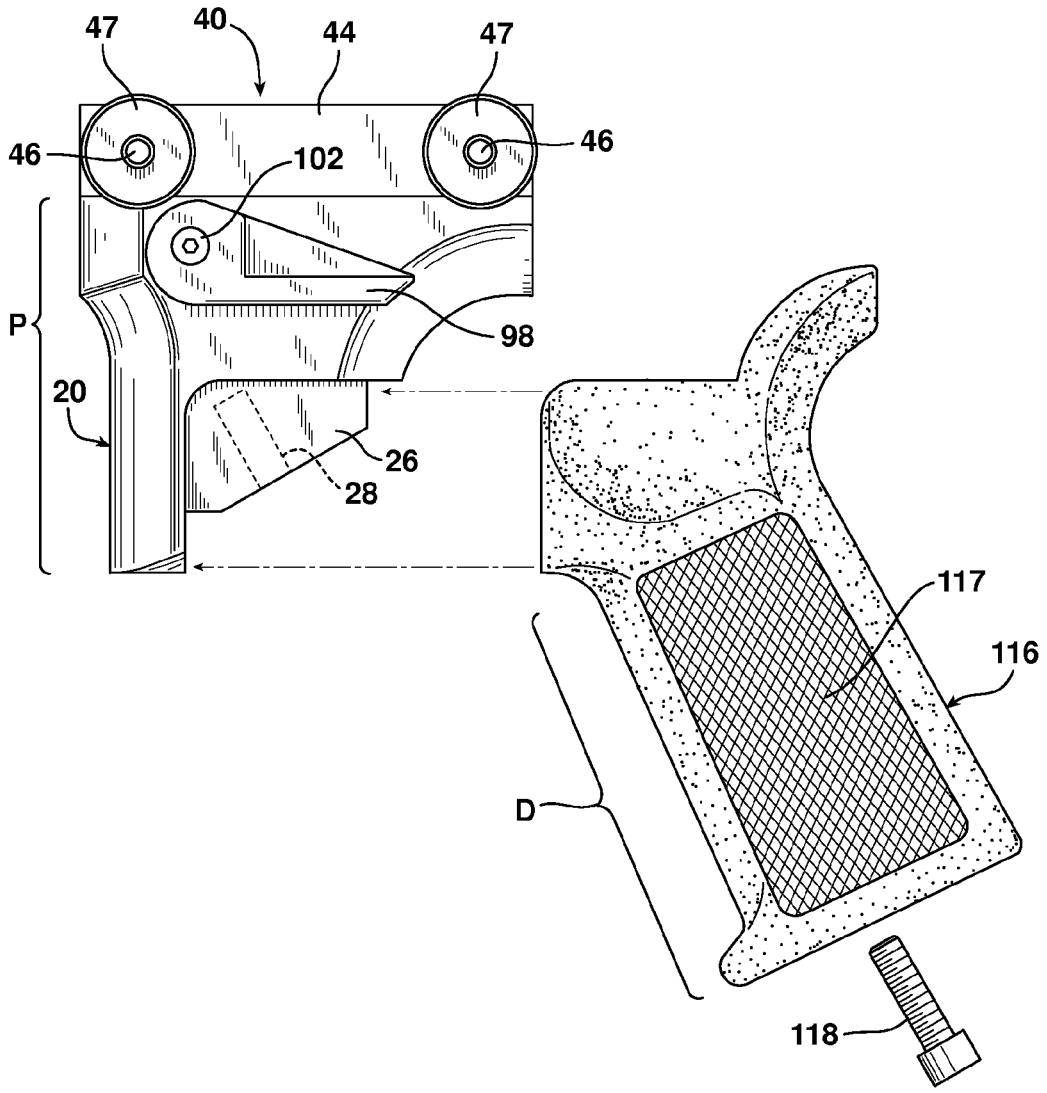
Figure 19:
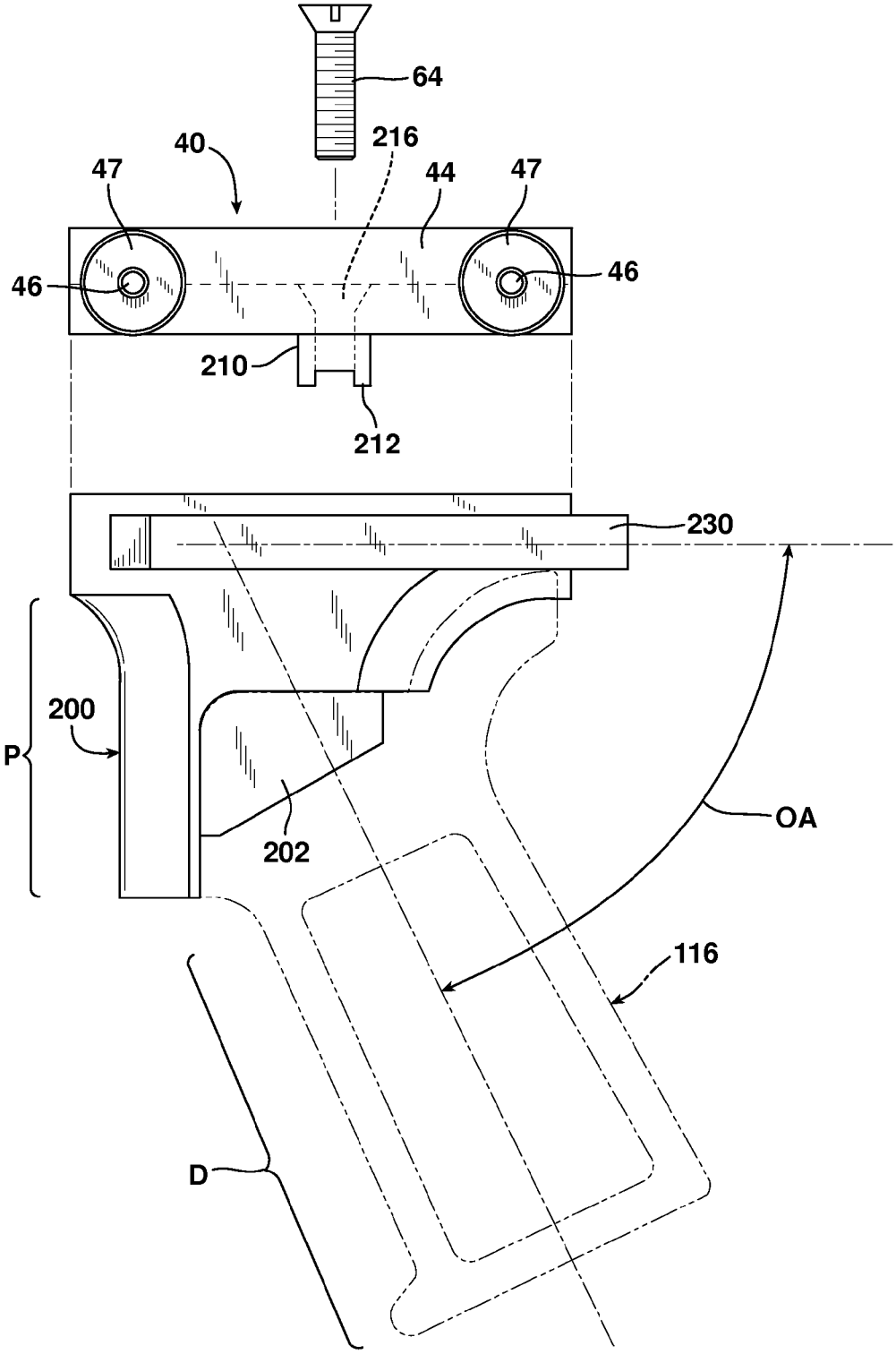
FIGS. 19-19D

Referring to FIGS. 3, 18 and 19 the distal portion D of the handgrip 116 is preferably hollow to permit the distal portion D to be removably mounted to the proximal portion P of the handgrip 116 by fastening retaining screw 118 into mating screw receptacle 28 in the proximal portion of the handgrip 116. Such a structure enables the user to change the distal portion D of the handgrips 116 to suit his/her preference for functionality and/or aesthetics, e.g., matching handgrips for the shooting hand and support hand.

Preferably, the handgrip 116 is sufficiently symmetrical to make it suitable for gripping by a shooter's right hand or left hand. Optionally, the shooter may install a butt or distal portion D of the handgrip 116 that makes it more suitable for either the right hand or left hand, e.g., a thumb rest is only on one side of the handgrip 116. If the opposite hand needs to be used then, the distal portion D of the handgrip 116 is then "switched out" to accommodate the opposite hand. As shown, in FIGS. 2 and 18, and particularly FIG. 2, the distal portion D of the handgrip 116 is offset from the proximal portion P in the Vertical Plane VP at an offset pivot angle OA of from about 80° to 30° degrees, preferably from about 65° to 45°.

Figure 12:
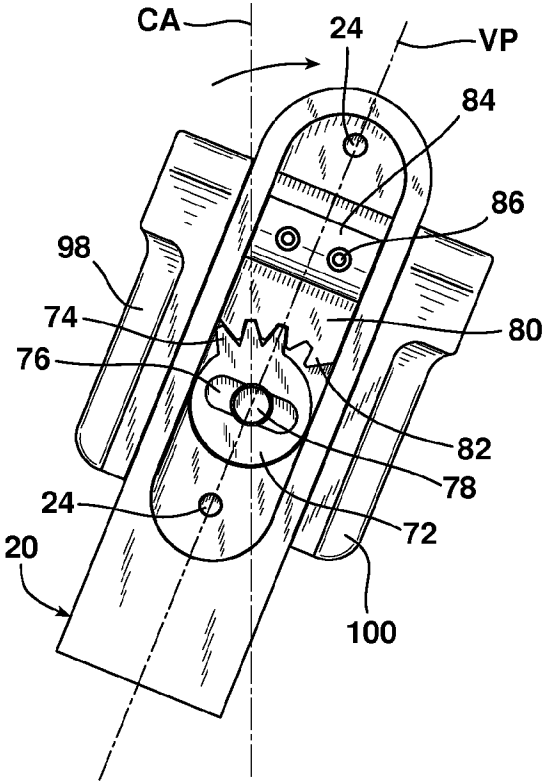
Figure 11:
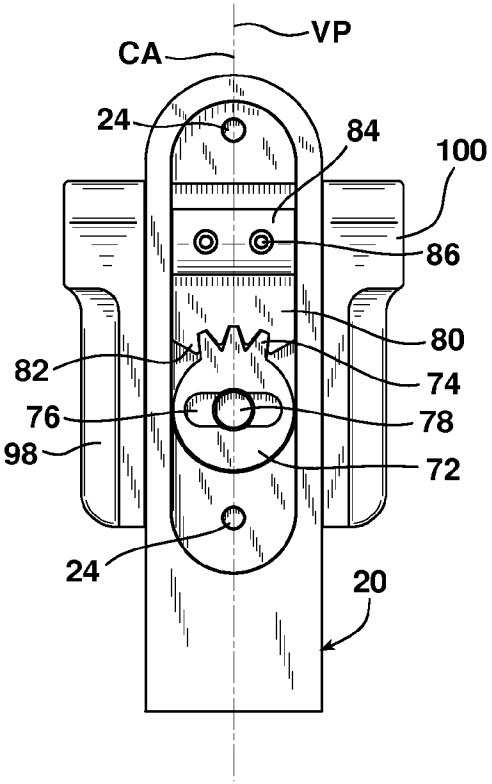
Figure 10:
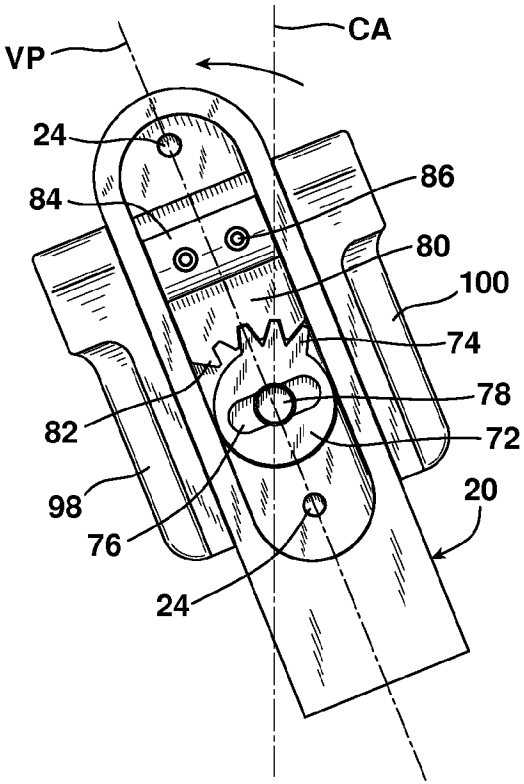
Figure 14:
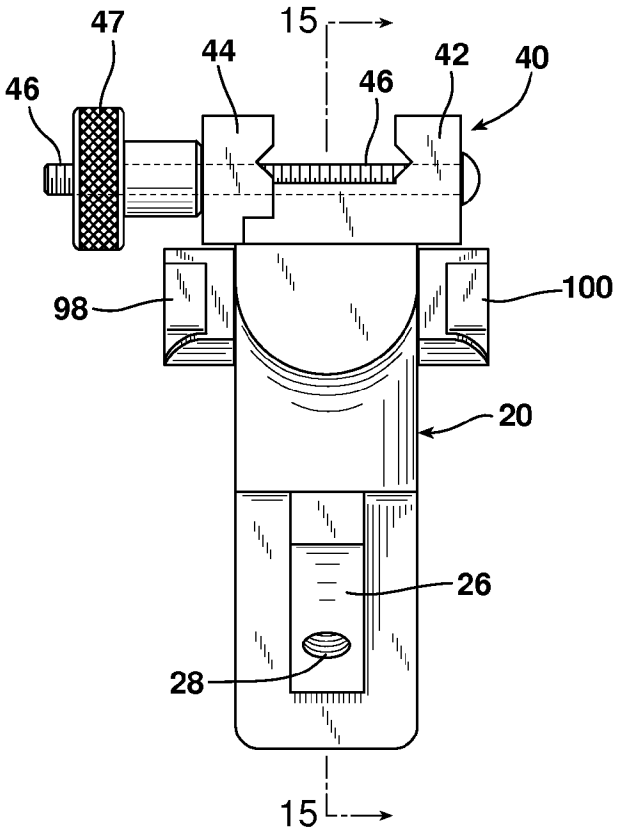

Referring, for example, to FIGS. 3, 4, 15-17 screw 64 passes through hole 66 along the Central Axis CA of stationary jaw 42 of rail mount 40 to secure the lower portion of rail mount 40 to the proximal portion P of the handgrip 116. The screw 64 also passes through cover plate 68 that covers the enclosure housing the interior mechanism in the proximal portion P of the handgrip 116. The cover plate 68 is secured to proximal portion P of the handgrip 116 by screws 70 that mate with threaded holes 24 in the handgrip 116. The screw 64 also passes through a lock connector 60 having thereon lock connector tooth 62, and threads into the base of pivot lock 72. The lock connector 60 and tooth 62 mate with receptacles 78 and 76, respectively to secure (through the cover plate 68) the rail mount 40 to the pivot lock 72. Thus when the rail mount 40 is secured to the rail 128 the pivot lock 72 does not pivot with respect to the rail 128. Reference is made to FIGS. 10, 11 and 12 wherein the pivot lock 72 does not pivot in relation to the Central Axis CA of the barrel 132 regardless of what direction the handgrip 20 is pivoted.

Referring to FIGS. 3, 10-12 and 17 pivot lock 72 has a plurality of engagement teeth 74 thereon. In the embodiment depicted herein there are three such teeth 74, with each tooth 74 determining a set predetermined angle the Vertical Plane VP of the handgrip 116 has with the Central Axis CA. The number of teeth 74 and the angles between the teeth 74 is a matter of choice on the number and variability of predetermined pivot angles desired. For example, four teeth can give you four different predetermined pivot angles.

Referring to FIGS. 2, 10-12 and 15-17, a lock block 80 is provided that mates with teeth 74 on pivot lock 72. A pivot pin 84 is fixedly mounted to lock block 80 by screws 86. The ends 88 of pivot pin 84 pass through holes 87 that are in the side walls of proximal portion P of the handgrip 116. The ends 88 of pivot pin 84 have locking flats which mate with locking levers 98. The locking levers 98 are secured to the ends 88 of pivot pin 84 by securing screws 102. As indicated it is preferred to have a locking lever 98 on each side of the handgrip 116 to permit either the left hand or right hand to maneuver the locking lever 98.

Figure 15:
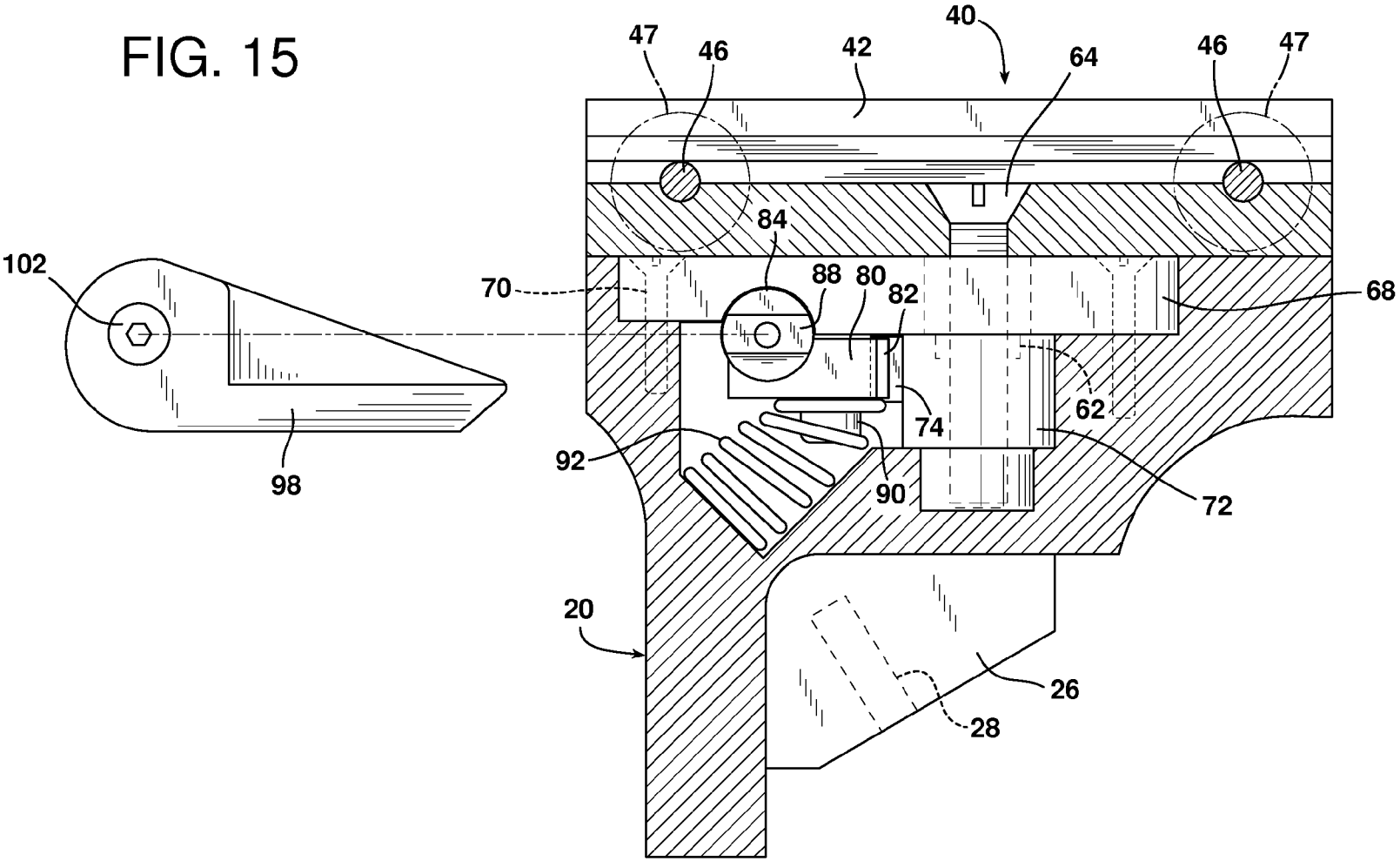
Figure 16:
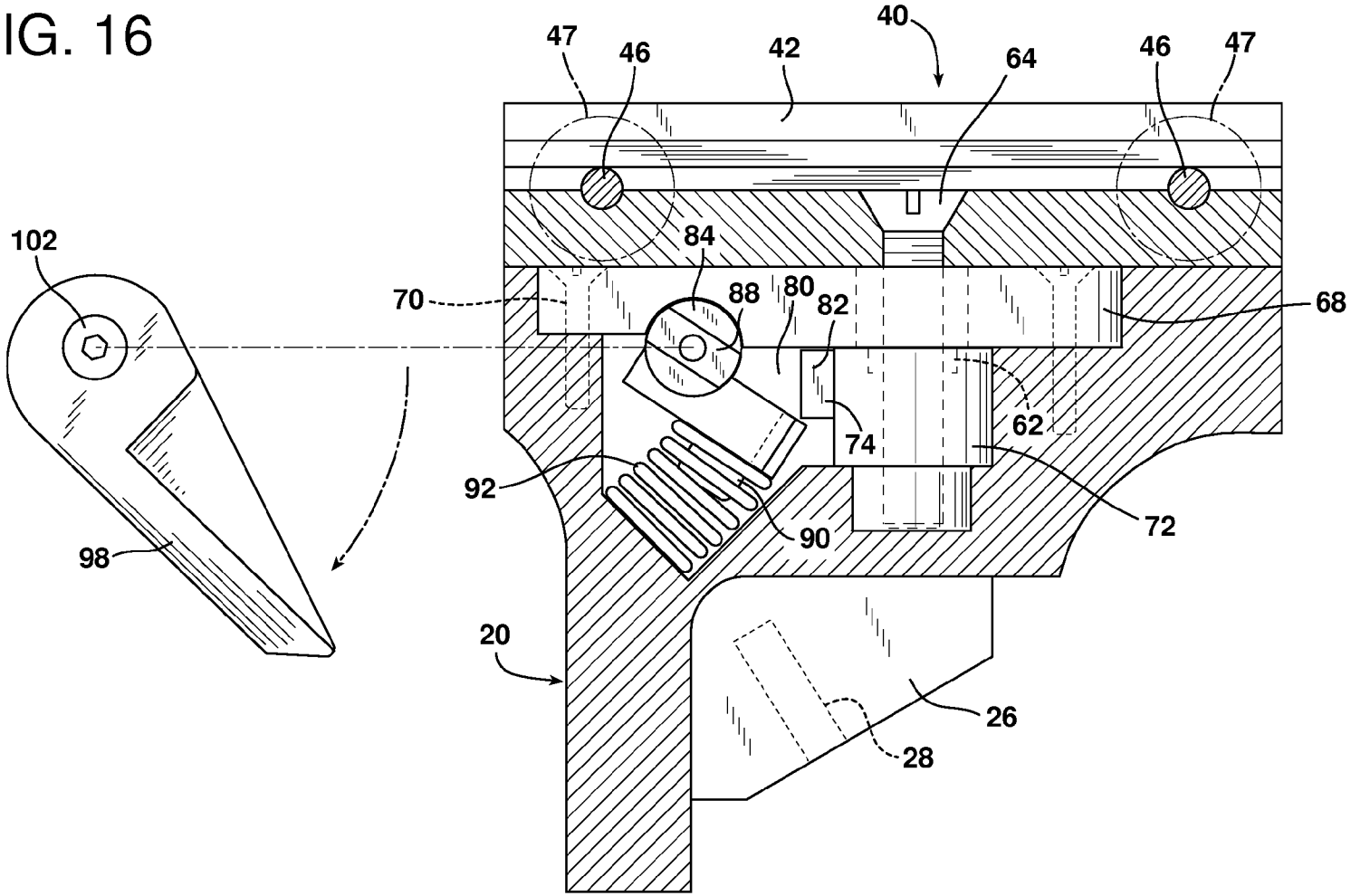
Figure 17:
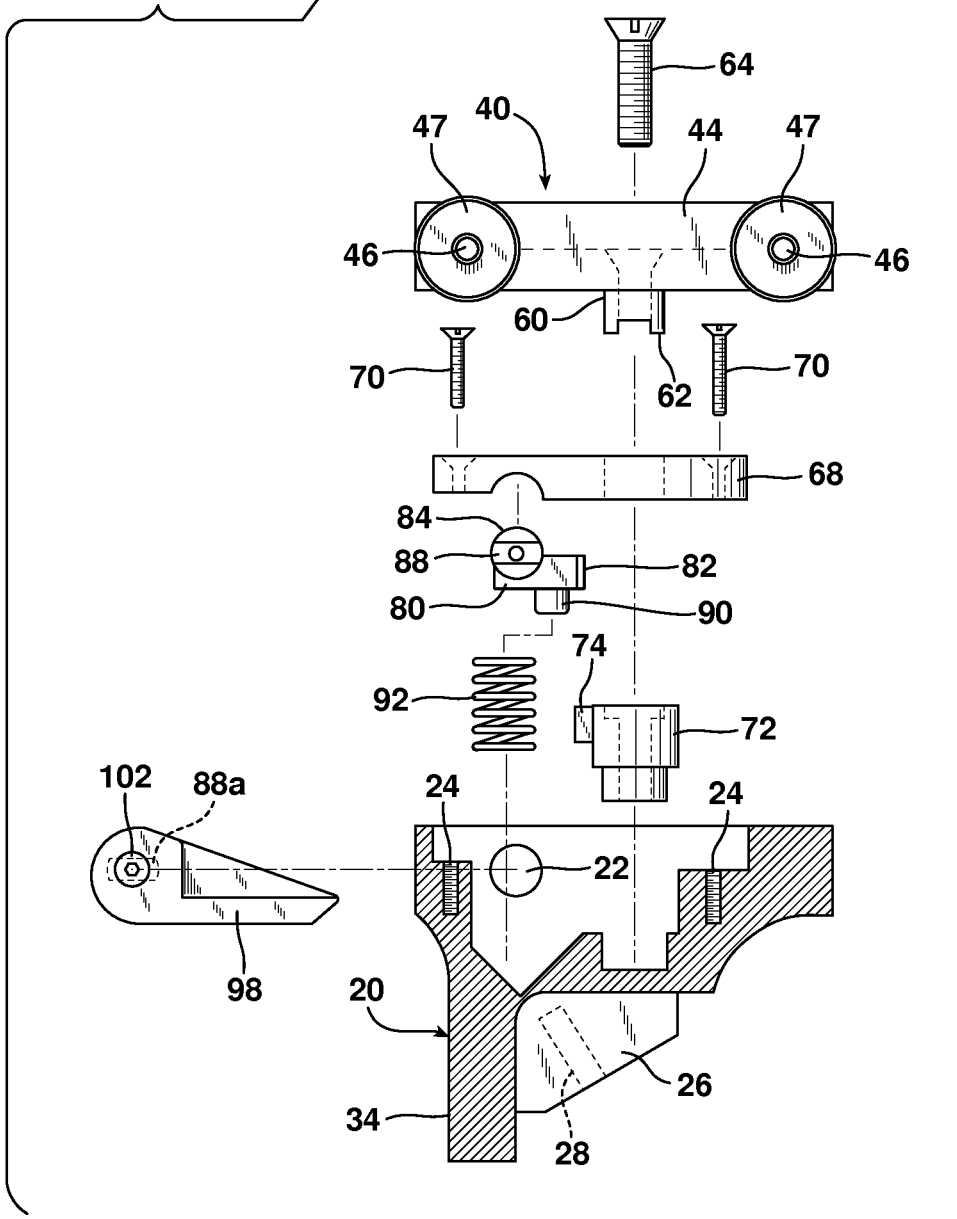
Figure 17A:
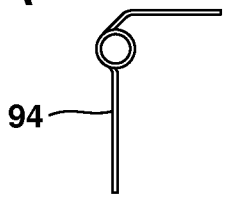
FIG. 17A is an alternate type engagement spring, i.e., torsion type.

Referring to FIGS. 15-17, mounted below locking block 80 is a retainer plug 90 for retaining one end of compression spring 92. The other end of spring 92 rests on spring shoulder 91. Thus, when the user desires to change the pivot angle of the handgrip 116, i.e., change the pivot angle between the Vertical Plane VP through the handgrip 116 and the Central Axis CA, the locking lever 98 is pressed downward (see FIG. 15 and arrow in 16) from its initial position and held in such position. This action compresses the spring 92 and releases engagement teeth 82 and 74 from each other. The handgrip 116 is then pivoted to the selected pivot angle, the locking lever 98 released causing the spring 92 to decompress, raise lever 98 to its initial position, and force teeth 82 and 74 into engagement with each other to lock the handgrip 116 in place. Optionally, alternate spring 94 depicted in FIG. 17 may be used in place of compression spring 92 with appropriate modifications to the spring shoulder and retainer means for such spring.

Figure 7:
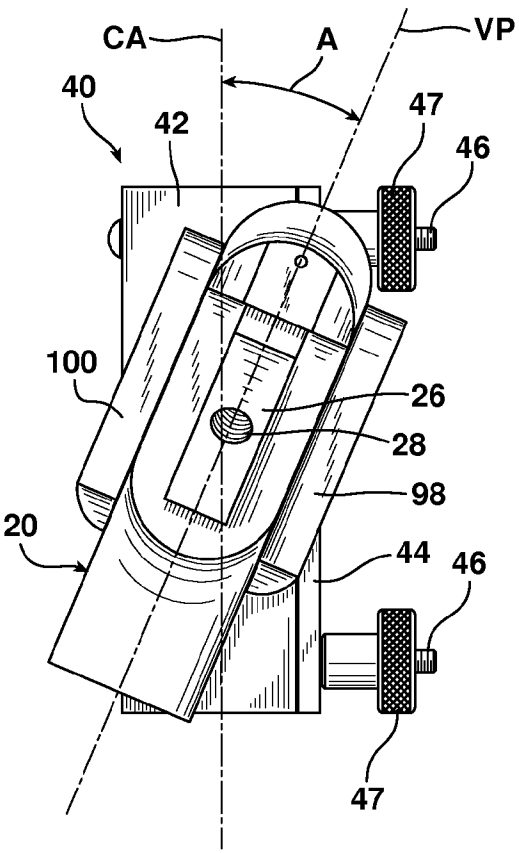

In the embodiment depicted the Vertical Plane VP has three set positions, i.e. about 20°-30° on each side of the Central Axis CA and on the Central Axis CA. Referring to the relevant Figures:

FIG. 7 is a bottom plan view of the handgrip apparatus 20 with the Vertical Plane VP of the handgrip 116 pivoted from the Central Axis CA and locked for gripping by the left hand, i.e., a right handed shooter.

Figure 8:
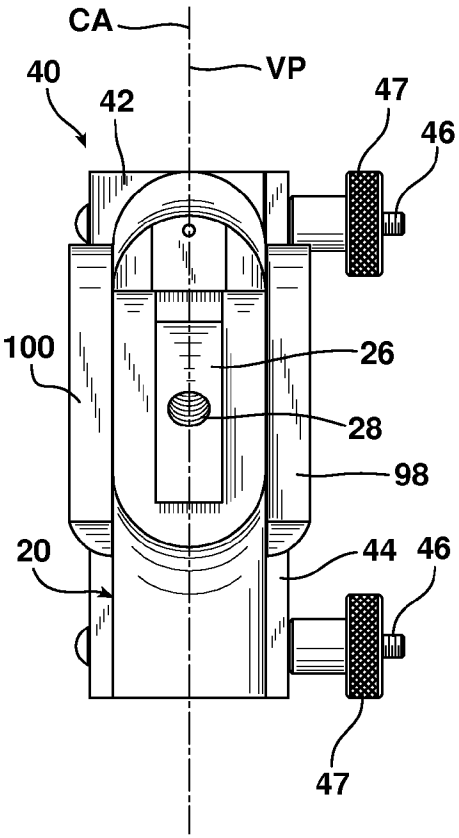

FIG. 8 is a bottom plan view of the handgrip apparatus 20 with the Vertical Plane VP of the handgrip 116 locked in line with the Central Axis CA or in a neutral position with the rail structure 128.

Figure 9:
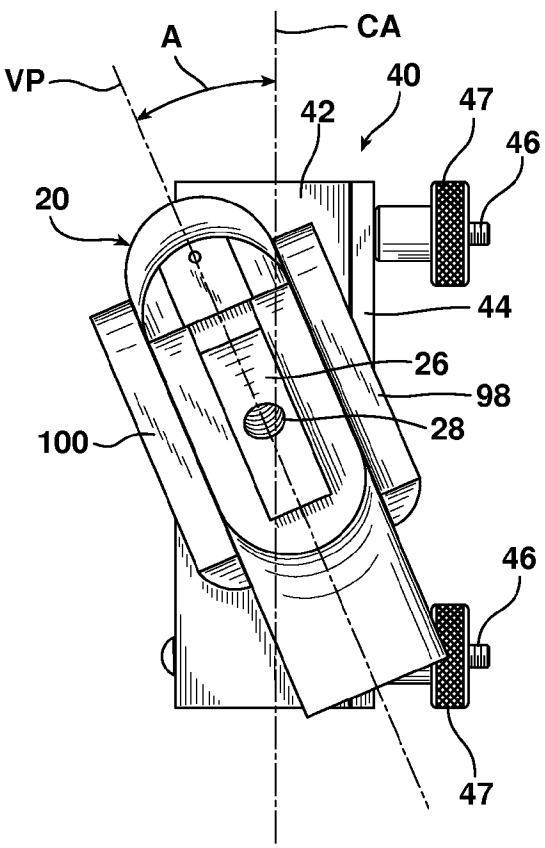

FIG. 9 is a bottom plan view of the handgrip apparatus 20 with the Vertical Plane VP of the handgrip 116 pivoted from the Central Axis CA and locked for gripping by the right hand, i.e., a left handed shooter.

FIG. 10 is a top plan view of the handgrip apparatus 20 with cover plate 68 and rail mount 40 removed with the Vertical Plane VP of the handgrip 116 pivoted from the Central Axis CA and locked for gripping by the right hand, i.e., a left handed shooter.

FIG. 11 is a top plan view of the handgrip apparatus 20 with cover plate 68 and rail mount 40 removed with the Vertical Plane VP of the handgrip 116 locked in line with the Central Axis CA or in a neutral position with the rail structure 128.

FIG. 12 is a top plan view of the handgrip apparatus 20 with cover plate 68 and rail mount 40 removed with the Vertical Plane VP of the handgrip 116 pivoted from the Central Axis CA and locked for gripping by the left hand, i.e., a right handed shooter.

Elements in Embodiment I:

P proximal portion of handgrip 116
D distal end of handgrip 116
VP Vertical Plane passing through handgrip 116
CA Central Axis of barrel 132
OA offset pivot angle (shown in FIGS. 2 and 19)
20 hand grip apparatus
22 hole for pivot pin 84
24 threaded holes for screws 70 for securing cover plate 68
26 boss for mounting handgrip 116
28 screw receptacle for securing handgrip 116 with retaining screw 118
34 finger hold
40 rail mount

42 stationary jaw of rail mount 40
43 interlocking surfaces of jaws 42, 44
44 clamping jaw of rail mount 40
45 dove-tailed rail engaging surface
46 tightening screws for connecting and stationary jaw 42 and clamping jaw 44
47 knurled locking nuts for tightening screws 46
60 lock connector
62 lock connector tooth
64 screw for securing rail mount 40 through lock connector 60 to handgrip mount 20
66 through hole in stationary jaw 42 for screw 64
68 cover plate for handgrip mount 20
70 screws for securing cover 68 plate to handgrip mount 20
72 pivot lock
74 engagement teeth of pivot lock 72
76 receptacle for lock connector tooth 62
78 receptacle for screw 64 and lock connector 60, 62.
80 lock block that mates with engagement teeth 74 of pivot lock 72
82 mating engagement teeth in lock block 80
84 pivot pin mounted to lock block 80 and levers 98 and 100
86 screws for mounting pivot pin 84 to lock block 80
87 pass through holes for pivot pin 84
88 ends of pivot pin 84 having locking flats at secured to locking levers 98 and 100
90 retainer plug and spring guide for spring 92 projecting from lock block 80
91 shoulder in enclosure in proximal portion for spring 92
92 compression spring mounted to retainer plug 92
94 alternate torsion type engagement spring for compression spring 92
98 locking lever secured to end of pivot pin 84
100 locking lever secured to end of pivot pin 84
102 securing screws for mounting locking levers 98 and 100 to locking flats 88 at ends of pivot pin 84
116 handgrip
117 sides of handgrip
118 retaining screw for handgrip 116
120 firearm—US Military Model M4
122 rifle receiver
121 rear handgrip
123 trigger
124 rifle magazine
125 rifle shoulder stock
126 rifle handguard
128 Picattiny rail
130 front rifle sight
132 rifle barrel
600 hand
602 arm
604 prior art handgrip Embodiment II

FIGS. 19-19D

Figure 19B:
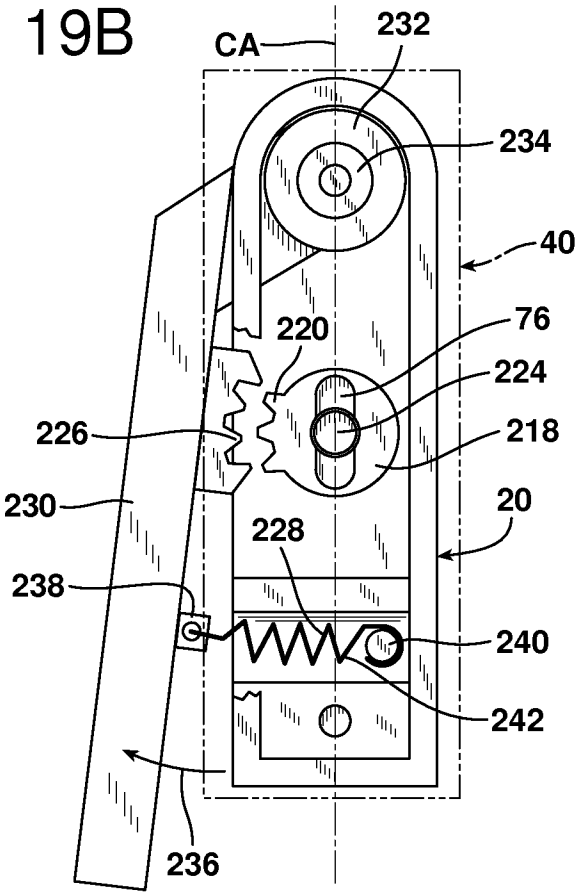
FIG. 19B is a top plan view of the Second Embodiment of the handgrip apparatus of this invention with the cover plate and rail mount removed and the handgrip in line with the Central Axis CA or in a neutral position with the rail structure wherein the horizontal clamping lever 230 is disengaged from the locking teeth 220 for pivoting the handgrip.
Figure 19A:
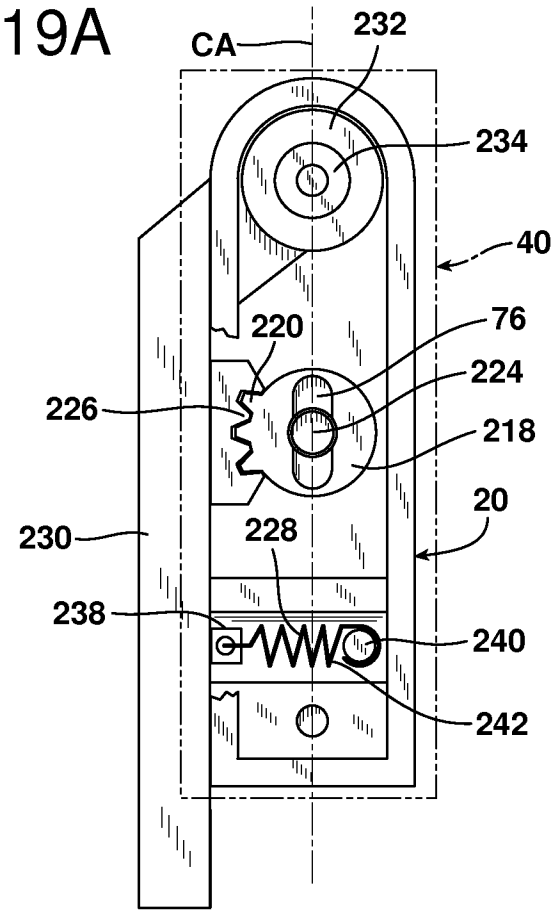
FIG. 19A is a top plan view of the Second Embodiment of the handgrip apparatus of this invention with the cover plate and rail mount removed and the handgrip locked in line with the Central Axis CA or in a neutral position with the rail structure utilizing the horizontal clamping lever 230.
Figure 19D:
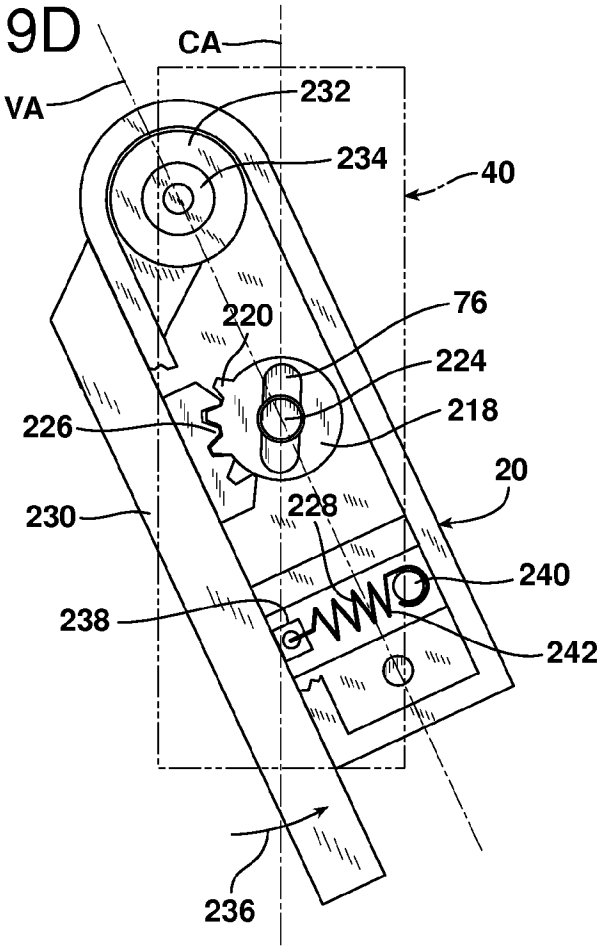
Figure 19C:
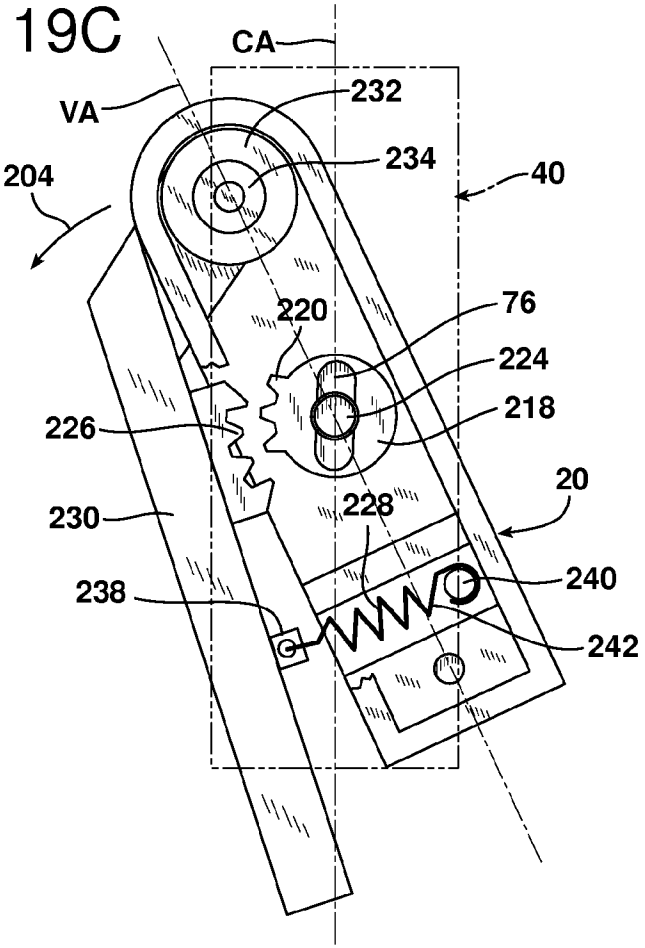
FIG. 19C is a top plan view of the Second Embodiment of the handgrip apparatus of this invention with cover plate and rail mount removed and the handgrip being pivoted to a position for gripping by the right hand i.e., a left handed shooter, the horizontal clamping lever 230 being disengaged from the locking teeth 220.

The Second embodiment, depicted in FIGS. 19-19D, distinguishes itself from the previous embodiment in that the locking lever 230 is pulled out from the initial position on the sides of the handgrip apparatus 200 to unlock the lock means rather than rotated downward as in the previous embodiment.

More specifically, referring FIG. 19, screw 64 passes through hole 216 in rail mount 40 to secure the lower portion of rail mount 40 to the proximal portion P of the handgrip 116. The screw 64 also passes through cover plate (not shown) that covers the enclosure housing the interior mechanism in the housing in the proximal portion P of the handgrip 116. The screw 64 also passes through a lock connector 210 having thereon lock connector tooth 212 and threads into the base of pivot lock 218. The lock connector 210 and tooth 212 mate with receptacle 76 to secure (through the cover plate) the rail mount 40 to the pivot lock 218. Thus when the rail mount 40 is secured to the rail the pivot lock 218 does not pivot with respect to the rail. Comparative reference is made, for example of FIG. 19A with 19D and FIG. 19B with 19C wherein the pivot lock 218 does not pivot in relation to the Central Axis CA regardless of which direction the handgrip 20 is pivoted.

Referring to FIGS. 19A-19D stationary pivot lock 218 has a plurality of engagement teeth 220 thereon. In the embodiment depicted herein there are three such teeth 220, with each tooth 220 determining a set predetermined pivot angle the Vertical Plane VP of the handgrip has with the Central Axis CA. The number of teeth 220 and the angles between the teeth 220 is a matter of choice on the number and variability of predetermined pivot angles desired. For example, five teeth can give you five different predetermined pivot angles, e.g., two on each side of the Central Axis CA and one "neutral" angle wherein the Vertical Plane VP and CA are coincident with each other.

Referring to FIGS. 19A-19D, a set of engagement teeth 226 are provided that mate with teeth 220 on pivot lock 218. Engagement teeth 226 are is fixedly mounted to lever 230. Lever 230 has a pivot post 232 at one end which mates with and rotates about axle 234 that is mounted in the enclosure in proximal portion P of the handgrip. Mounted near the other end of the lever 230 is spring latch 238 to which one end of an extension spring 242 is mounted. Mounted within the enclosure in proximal portion P of the handgrip is spring post 240 to which the other end of the extension spring 242 is mounted. Thus, when the user desires to change the pivot angle of the handgrip 116, i.e., change the pivot angle between the Vertical Plane VP and the Central Axis CA, the locking lever 230 is pulled away from the sides of the handgrip (see FIG. 19B) in the direction indicated by arrow 236 from its initial position and held in such position. This action stretches the spring 242 and releases engagement teeth 226 and 220 from each other. The handgrip 20 is then pivoted to the selected pivot angle, the locking lever 230 released causing the spring 242 to return to its original position pulling the lever back to its initial position and forcing teeth 226 and 220 into engagement with each other to lock the handgrip in place.

Elements in Embodiment II:

P proximal portion of handgrip 116
D distal end of handgrip 116
VP Vertical Plane passing through handgrip 116
CA Central Axis of barrel 132
200 handgrip apparatus
202 boss for mounting handgrip 116
204 swivel direction of handgrip
210 lock connector for connecting rail mount 40 to pivoting hand grip mount 200 and securing the stationary pivot lock 218
212 lock connector tooth
216 through hole in rail mount 40 for screw 64
218 stationary pivot lock
220 engagement teeth of stationary pivot lock 218
224 receptacle for screw 64
226 engagement teeth on lever 226
228 engagement spring
230 lever for engaging and disengaging teeth 220, 226
232 pivot post for lever 230

234 axle for pivot post 234
236 direction of lever 230
238 spring latch for mounting one end of extension spring 242
240 spring post for mounting the other end of extension spring 242
242 extension spring Embodiment III

FIGS. 20-22C

The Third embodiment, depicted in FIGS. 20-22C, distinguishes itself from the previous embodiments in that a handle 305 is located at the rear of the handgrip 300 along the Vertical Plane VP of the handgrip 300 and is pulled out from the initial position to unlock the lock means.

More specifically, referring FIG. 20-22C the lower portion of rail mount 40 is secured to the proximal portion P of the handgrip 116. In a similar manner to the other embodiments, the rail mount 40 is secured to the stationary pivot lock 302. Thus when the rail mount 40 is secured to the rail the stationary pivot lock 302 does not pivot with respect to the rail. Comparative reference is made, for example of FIG. 21A with 21D and FIG. 22 with 22C wherein the stationary pivot lock 302 does not pivot in relation to the Central Axis CA regardless of the direction the handgrip 300 is pivoted.

Referring to FIGS. 20-22C the stationary pivot lock 302 has a plurality of engagement teeth 303 thereon. In the embodiment depicted herein there are three such teeth 303, with each tooth 303 determining a set predetermined pivot angle the Vertical Plane VP of the handgrip has with the Central Axis CA. As stated previously, the number of teeth 303 and the angles between the teeth 303 is a matter of choice on the number and variability of predetermined pivot angles desired.

Figure 20:
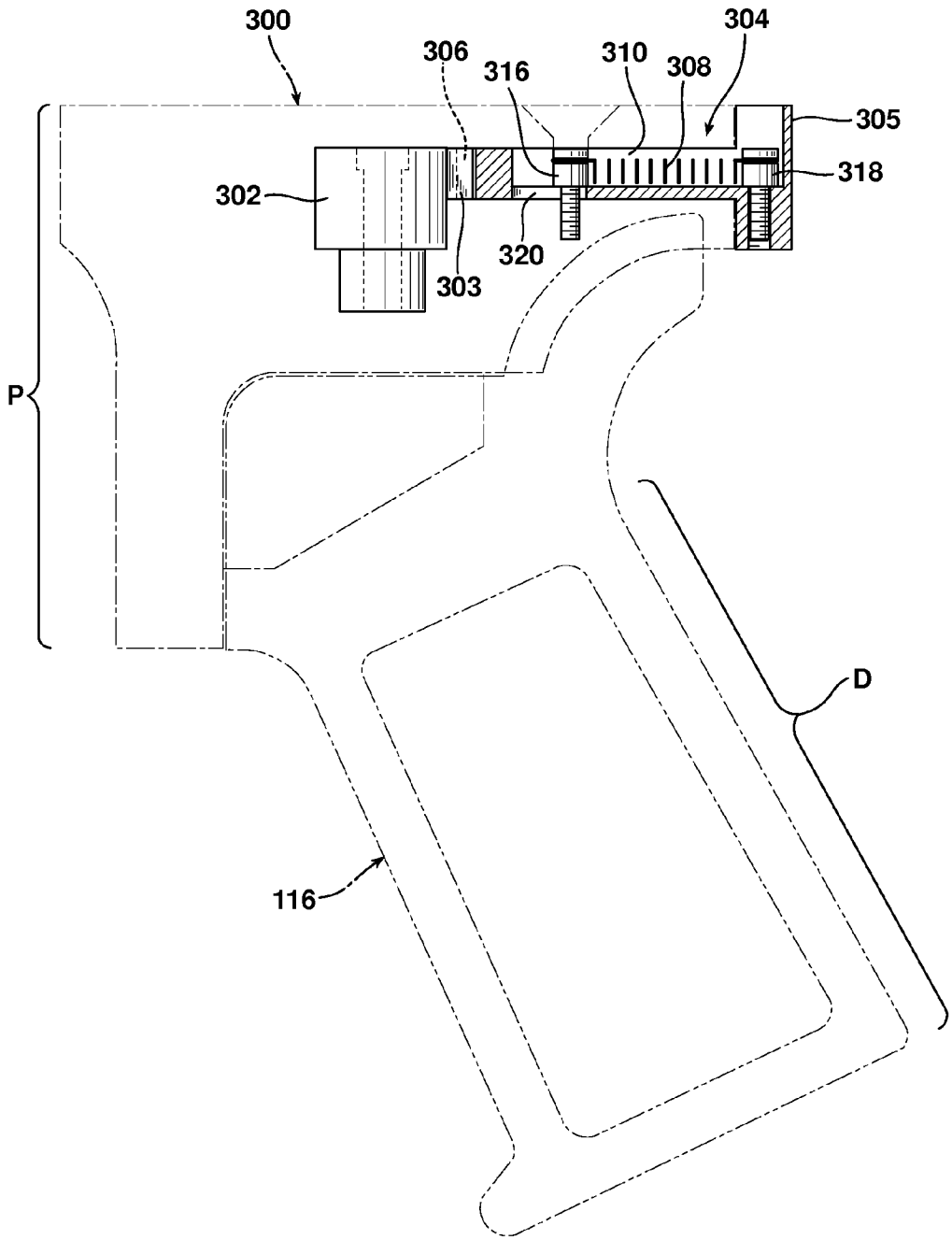
FIGS. 20-22C
Figure 21:
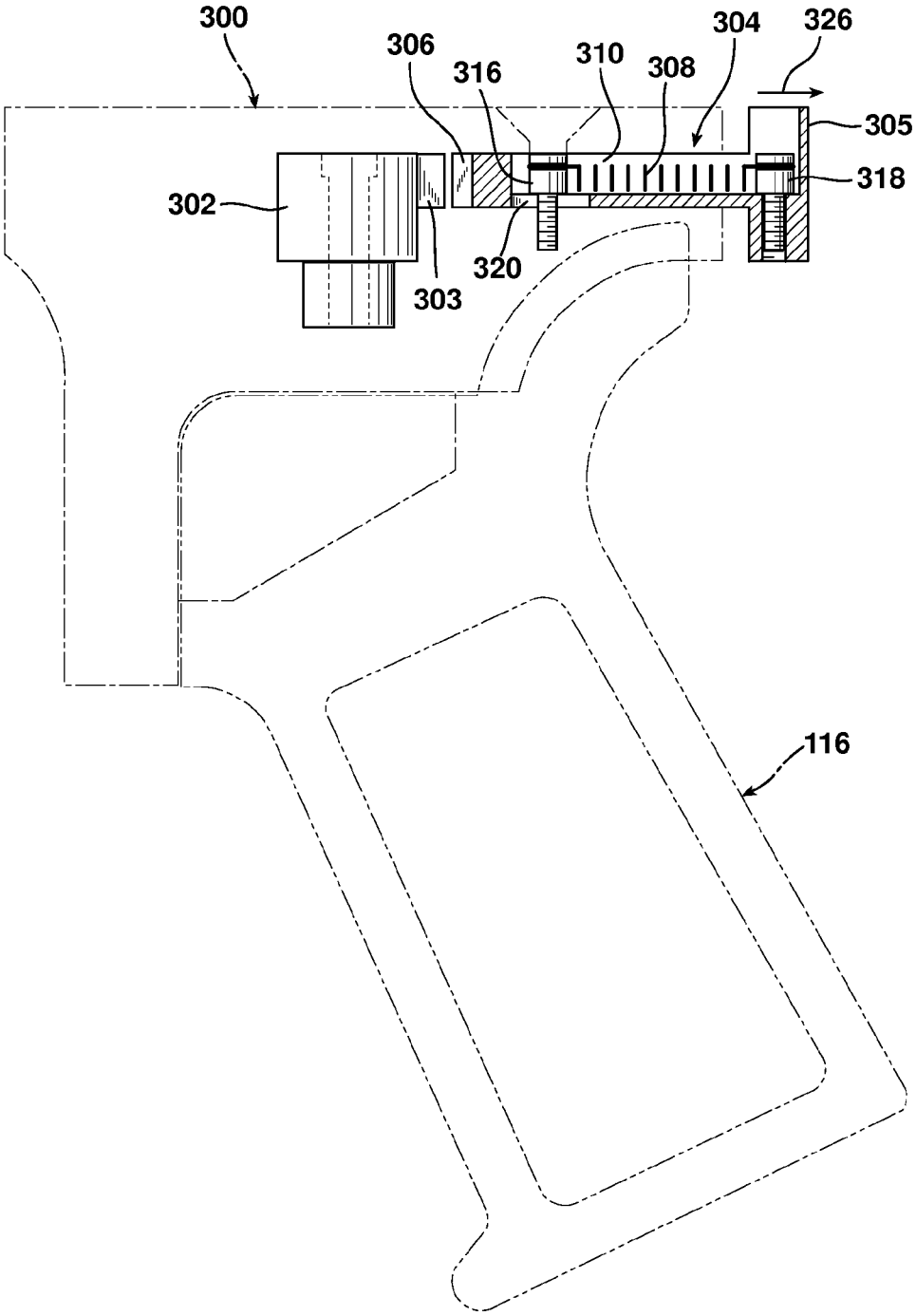
Figure 21B:
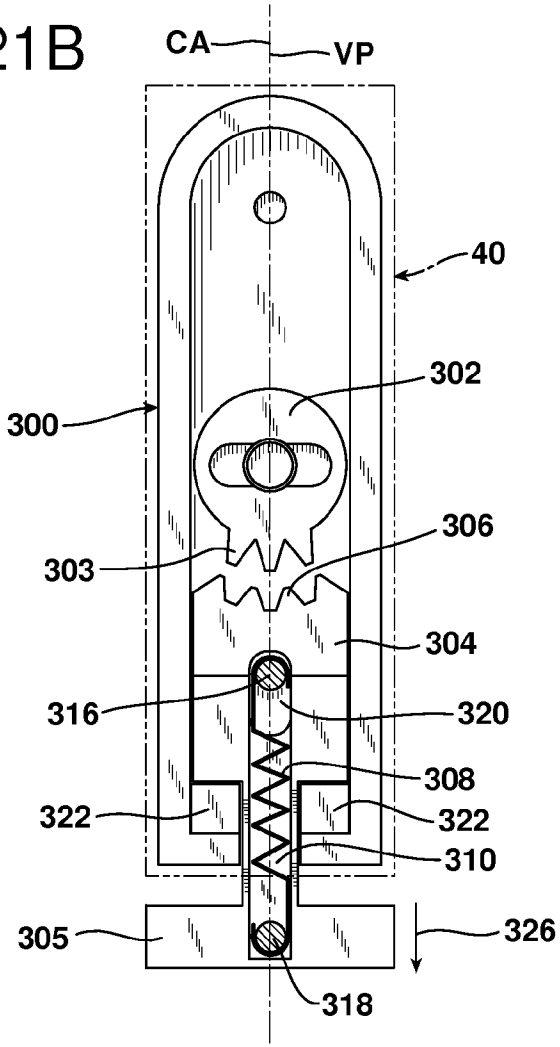
FIG. 21B is a top plan view of the Third Embodiment of the handgrip apparatus of this invention with the cover plate and rail mount removed and the handgrip positioned in line with the Central Axis CA or in a neutral position with the rail structure with the pivot locking mechanism disengaged for pivoting of the handgrip.
Figure 21A:
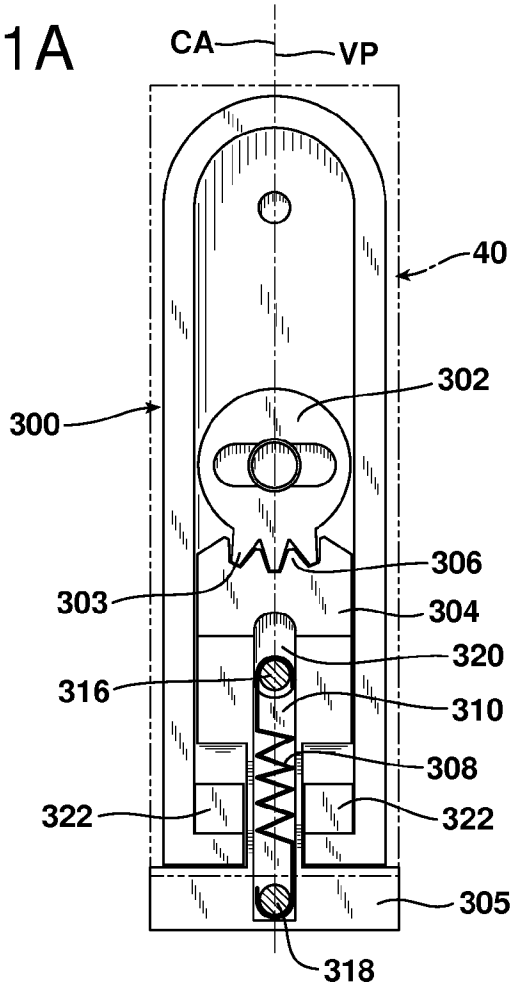
FIG. 21A is a top plan view of the Third Embodiment of the handgrip apparatus of this invention with the cover plate and rail mount removed and the handgrip locked in line with the Central Axis CA or in a neutral position with the rail structure utilizing the pivot locking mechanism.
Figure 21D:
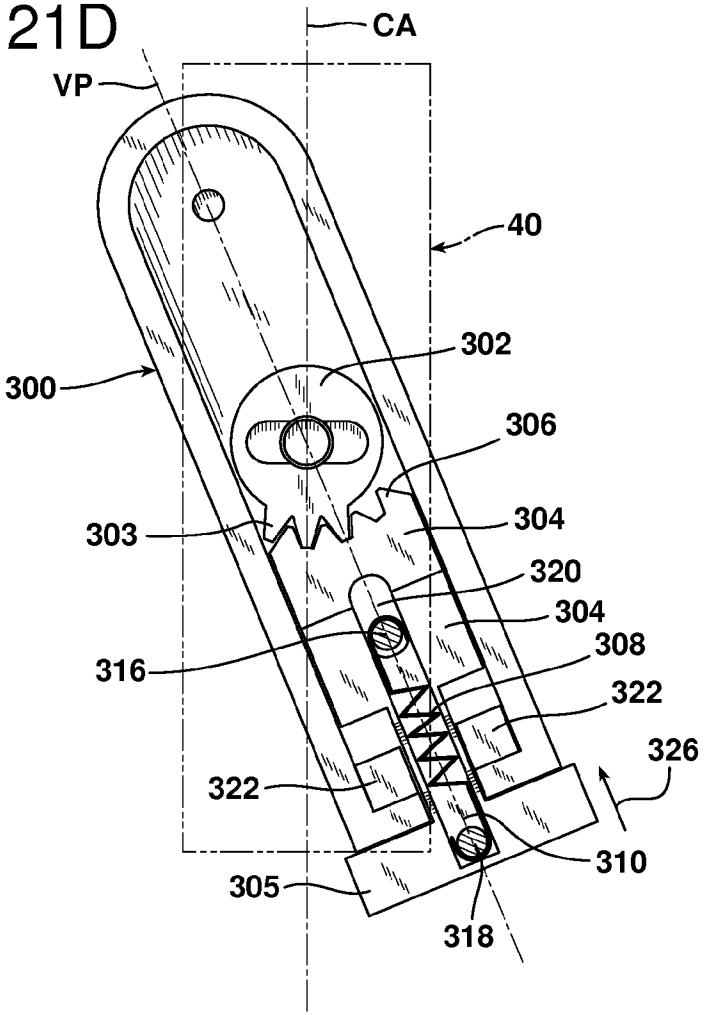
FIG. 21D is a top plan view of the Third Embodiment of the handgrip apparatus of this invention with the cover plate and rail mount removed and the handgrip in a locked position for gripping by the right hand i.e., a left handed shooter, the pivot locking mechanism being engaged with the locking teeth.
Figure 21C:
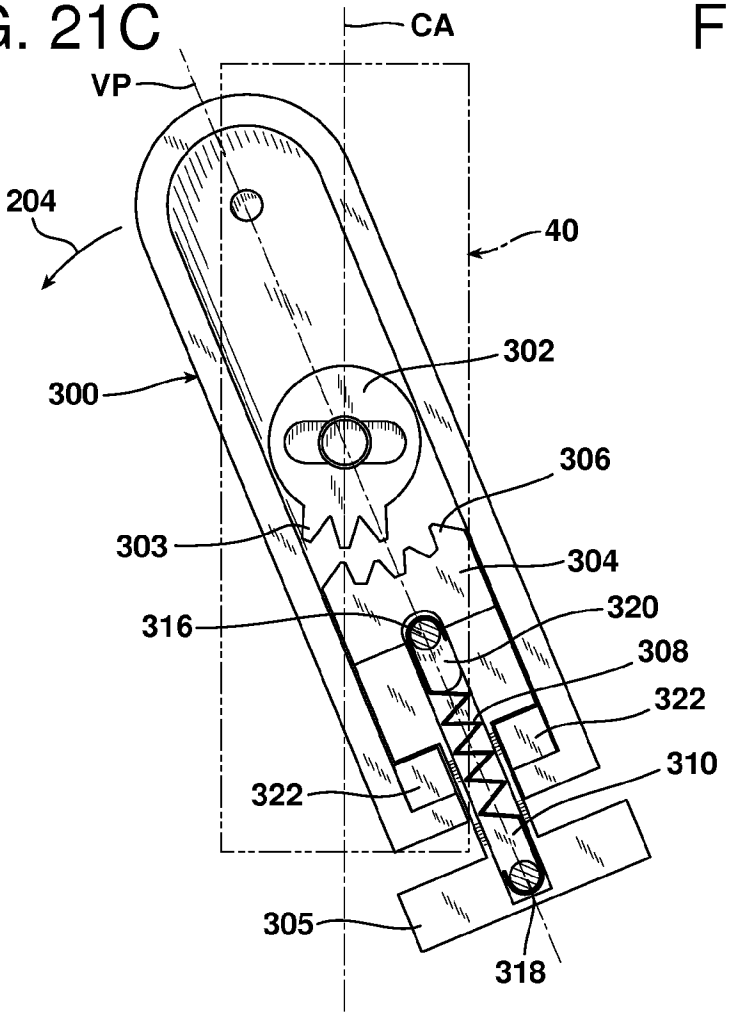
FIG. 21C is a top plan view of the Third Embodiment of the handgrip apparatus of this invention with the cover plate and rail mount removed and the handgrip being pivoted to a position for gripping by the right hand i.e., a left handed shooter, the pivot locking mechanism being disengaged from the locking teeth.

Referring to FIGS. 20-21D, a set of engagement teeth 306 are provided that mate with teeth 303 on the stationary pivot lock 302. Engagement teeth 306 are fixedly mounted to retractable pivot lock 304 which is connected to handle 305. Retractable pivot lock 304 slidably mates with slot 320 that is within the enclosure in proximal portion P of the handgrip. Within the retractable pivot lock 304 is a spring channel 310. Within spring channel 310 is a spring retainer rod 316 that is fixedly mounted to proximal portion P of the handgrip. Within the handle 305 is a second spring retainer rod 318 that moves with the handle 305. An extension spring 308 is mounted on one end on rod 316 and on the other end to rod 318. Thus, when the user desires to change the pivot angle of the handgrip 116, i.e., change the pivot angle between the Vertical Plane VP and the Central Axis CA, the handle 305 is pulled away from the rear of the handgrip (see FIG. 21B) in the direction indicated by arrow 326 from its initial position and the retractable pivot lock 304 is held in such position against spring stop 322. This action stretches the spring 308 and releases engagement teeth 303 and 306 from each other. Referring to FIG. 21C, the handgrip 300 is then pivoted to the selected pivot angle. Referring to FIG. 21D, the handle 305 is released causing the spring 308 to return to its original position and pulling the handle 305 back to its initial position and force teeth 303 and 306 into engagement with each other to lock the handgrip in place.

Figure 22A:
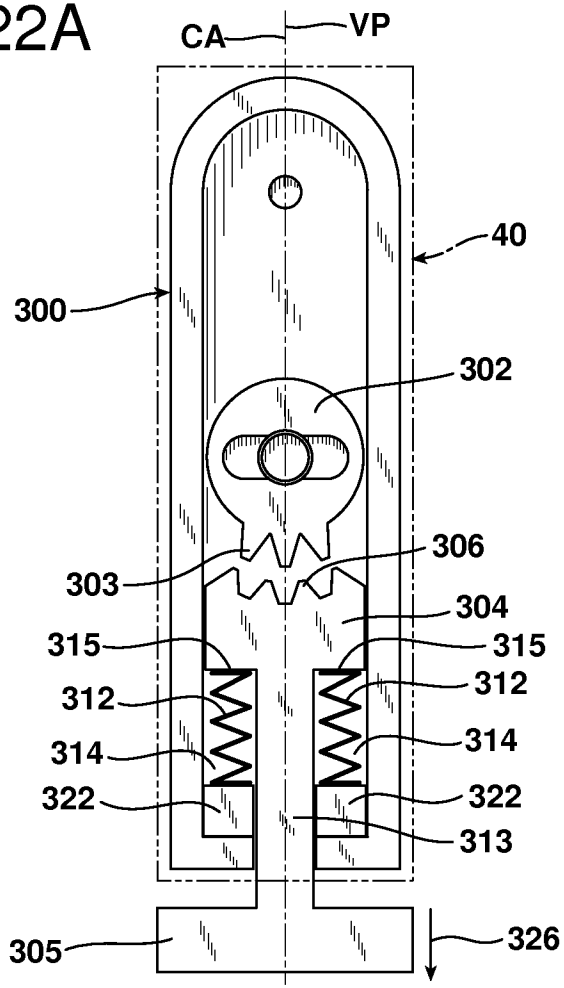
FIG. 22A is a top plan view of the Third Embodiment of the handgrip apparatus of this invention with the cover plate and rail mount removed and the handgrip positioned in line with the Central Axis CA or in a neutral position with the rail structure with the pivot locking mechanism with the alternate compression spring configuration disengaged for pivoting of the handgrip.
Figure 22:
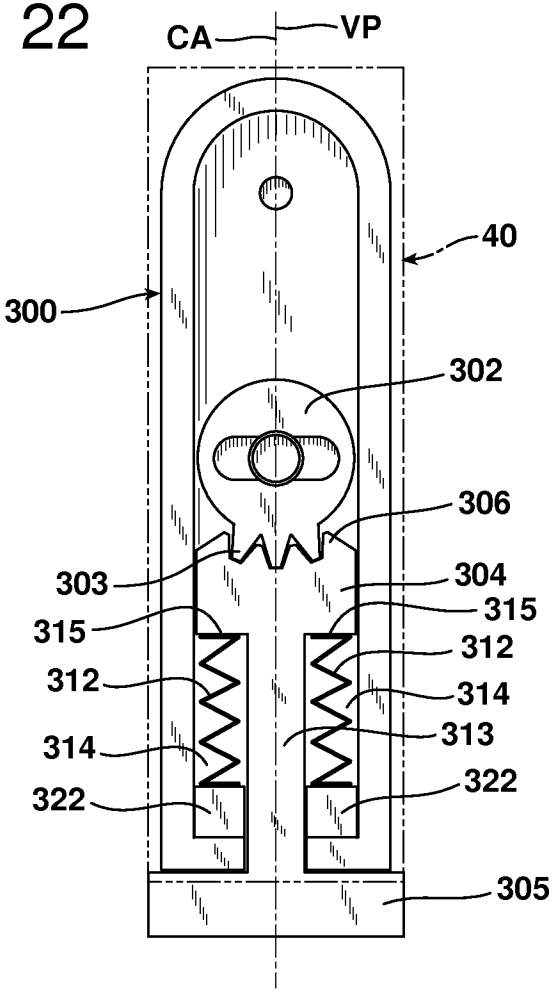
Figure 22C:
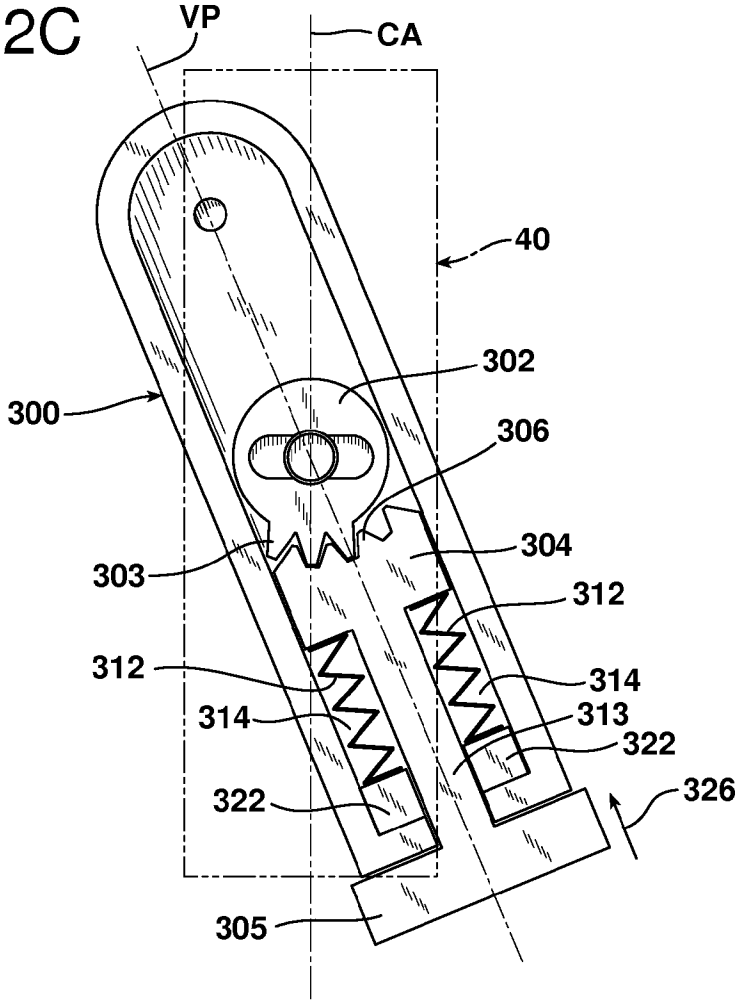
Figure 22B:
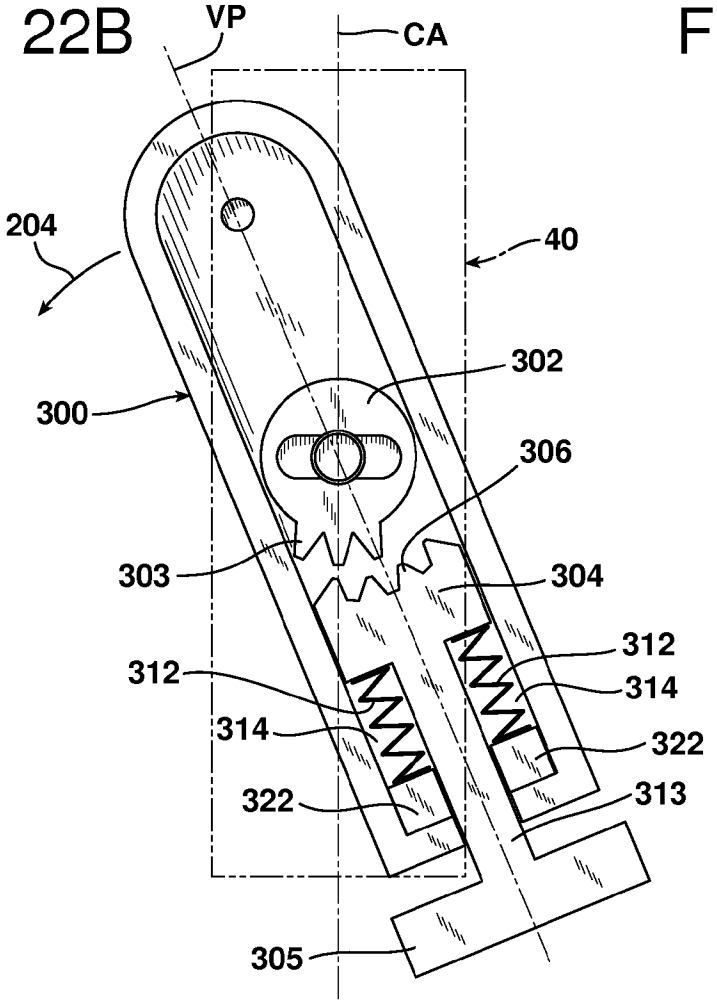
FIG. 22B is a top plan view of the Third Embodiment of the handgrip apparatus of this invention with the cover plate and rail mount removed and the handgrip being pivoted to a position for gripping by the right hand i.e., a left handed shooter, the pivot locking mechanism with the alternate compression spring configuration being disengaged from the locking teeth.

Referring to FIGS. 22, 22A-C, optionally retractable pivot lock 304 may have a plurality of compression springs 312 surrounding the connecting rod 313 between the spring stop 322 and the shoulder 315. Thus, when the user desires to change the pivot angle of the handgrip 116, i.e., change the pivot angle between the Vertical Plane VP and the Central Axis CA, the handle 305 is pulled away from the rear of the handgrip (see FIG. 22A) in the direction indicated by arrow 326 from its initial position and the retractable pivot lock 304 compresses springs 312 between spring stop 322 and shoulder 315 and releases engagement teeth 303 and 306 from each other. Referring to FIG. 22B, the handgrip 300 is then pivoted to the selected pivot angle. Referring to FIG. 22C, the handle 305 is released causing the springs 312 to return to their original positions and pulling the handle 305 back to its initial position and force teeth 303 and 306 into engagement with each other to lock the handgrip in place.

Elements in Embodiment III:
P proximal portion of handgrip 116
D distal end of handgrip 116
VP Vertical Plane passing through handgrip 116
CA Central Axis of barrel 132
300 handgrip apparatus
302 stationary pivot lock
303 teeth of stationary pivot lock 302
304 retractable pivot lock
305 handle for retractable pivot lock 304
306 engagement teeth on retractable pivot lock 304
308 single engagement spring
310 spring channel for single engagement spring 308
312 plurality of compression springs
313 connecting rod connecting handle 305 and retractable pivot lock 304
314 spring channels for multiple engagement springs 312
315 shoulder of retractable pivot lock 304
316 spring retainer rod for retractable pivot lock 304
318 spring retainer rod for retractable pivot lock handle 305
320 slot for retraction movement of retractable pivot lock 304
322 spring stop for retractable pivot lock 304 and height spacer for cover plate (not shown).
326 arrow showing direction of movement Embodiment IV

FIGS. 23-31

The Fourth embodiment, depicted in FIGS. 23-31, distinguishes itself from the previous embodiments in that the a lock means for locking and unlocking the pivot means to lock the Vertical Plane of the handgrip at a pivot angle to the Central Axis is a frictional type lock controlled by a rotating a knob 422 that controls an adjustment screw 418 that moves two wedges 408 and 400 with respect to each other.

Figure 23:
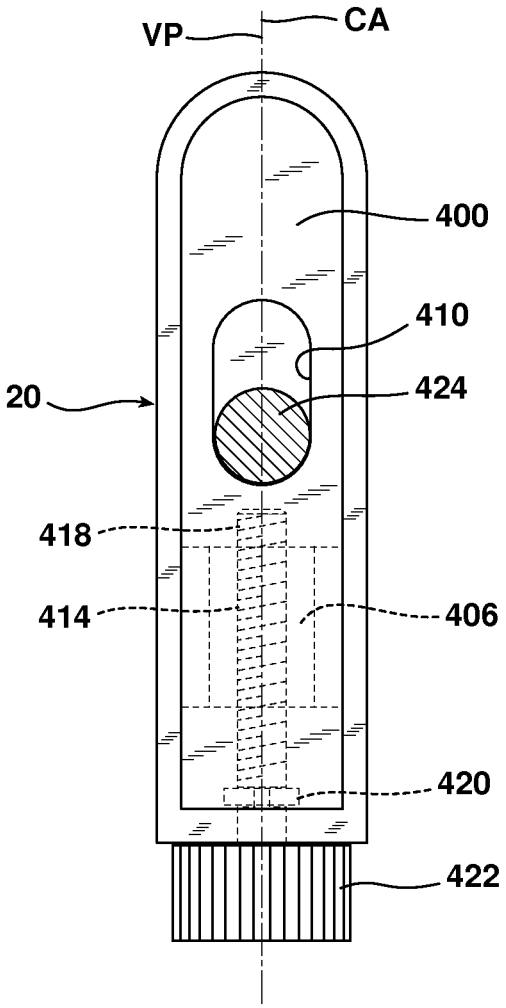
FIGS. 23-31
Figure 23A:
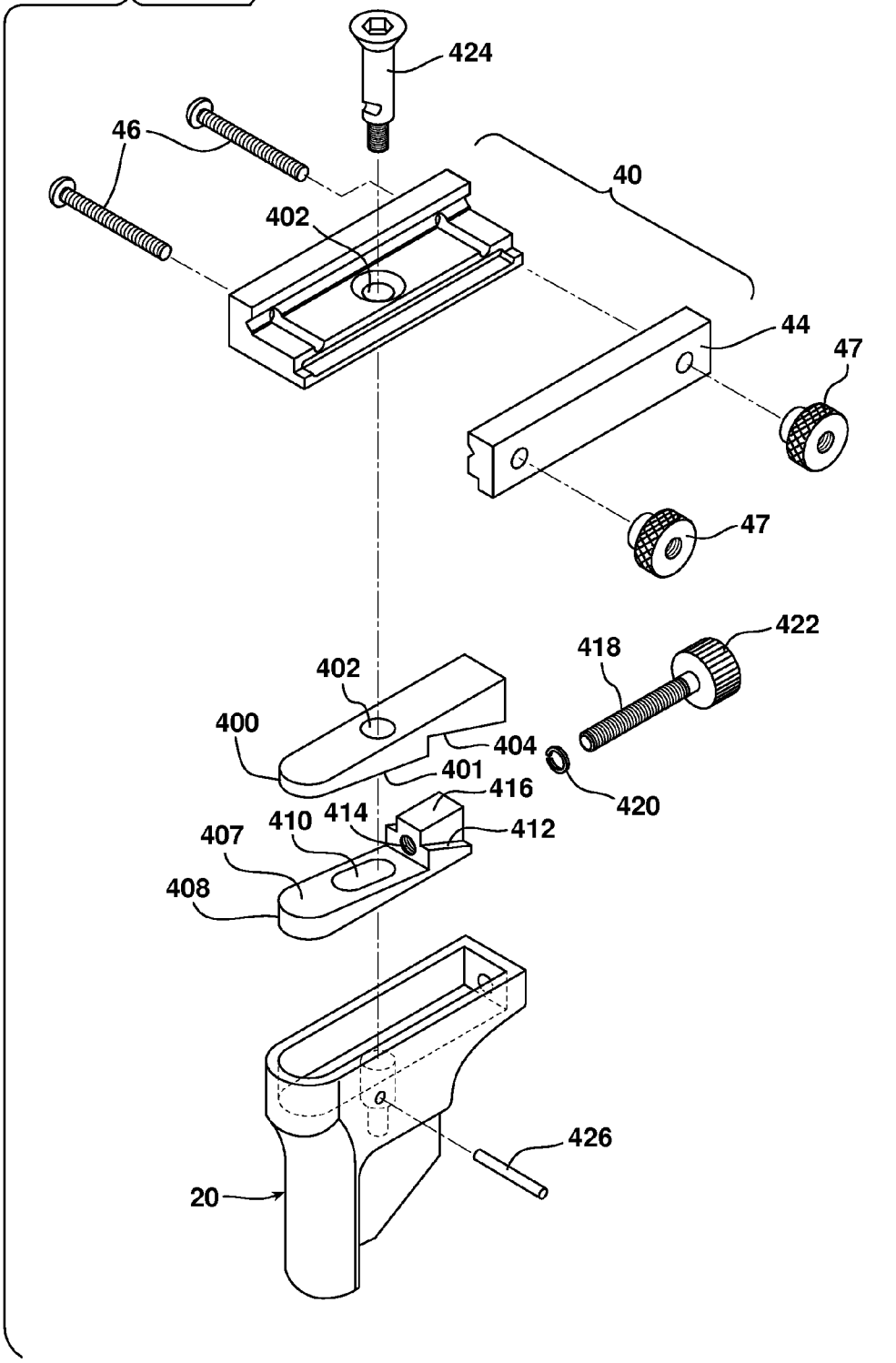
FIG. 23A is an exploded front/left-side perspective view of the Fourth Embodiment of the handgrip apparatus of this invention shown in increased scale.
Figure 24:
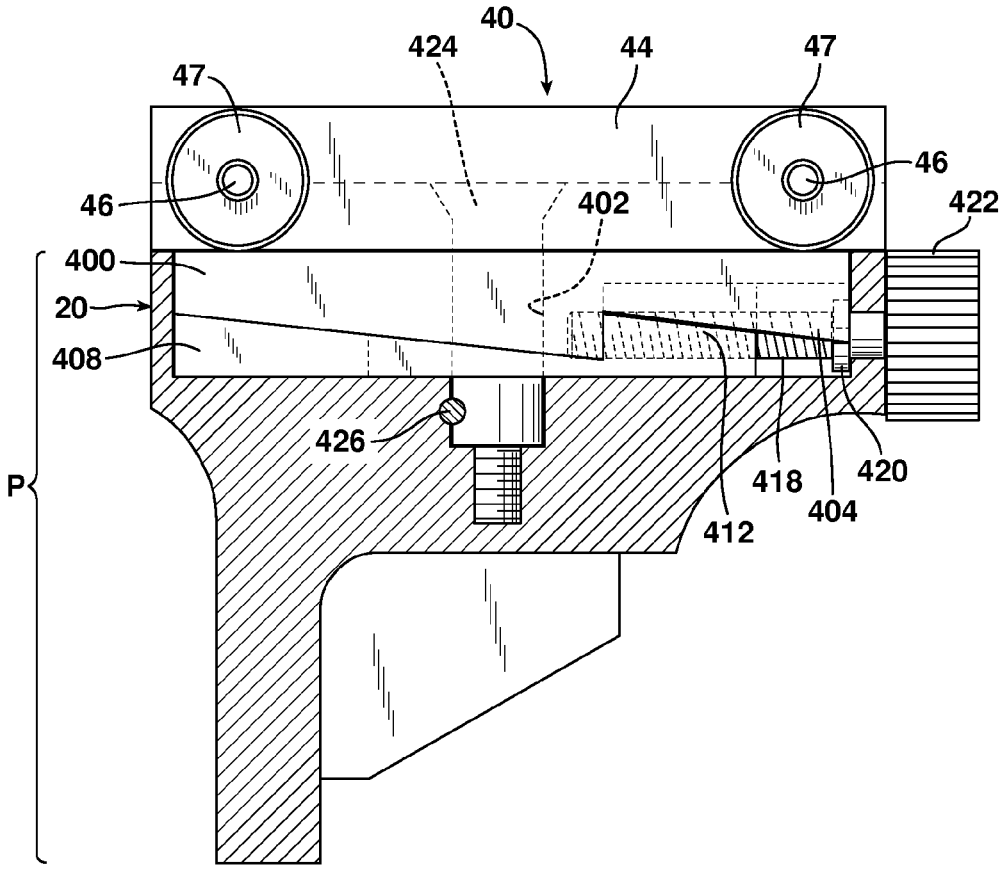
Figure 24A:
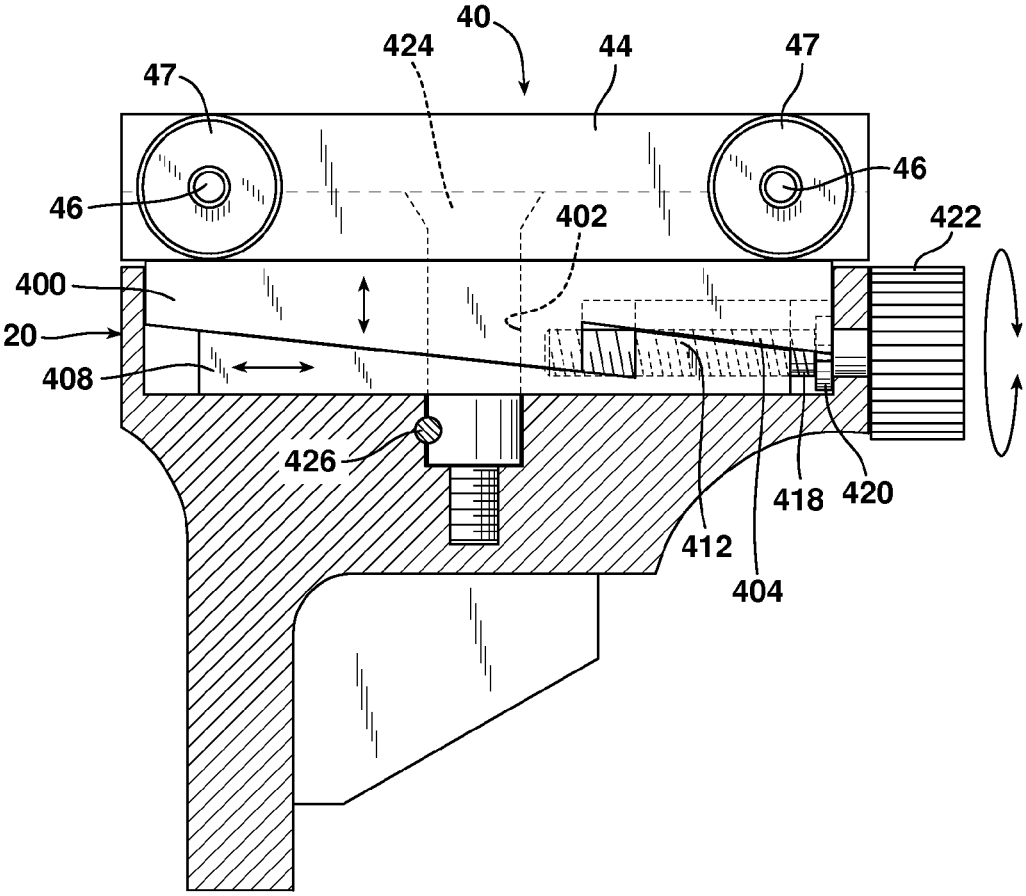
FIG. 24A is a cross-sectional left side view of the Fourth Embodiment of the handgrip apparatus of FIG. 23 utilizing a frictional locking mechanism indicating how to tighten or lock the handgrip in place and how to loosen or unlock the handgrip to permit pivoting of the handgrip.
Figure 25:
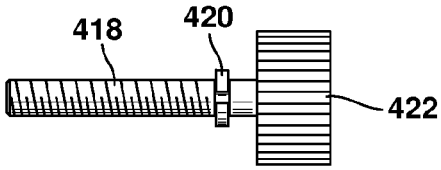
Figure 26:
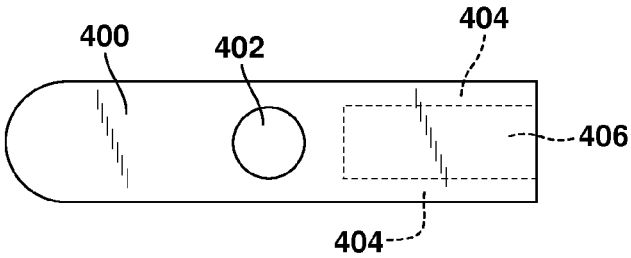
Figure 27:
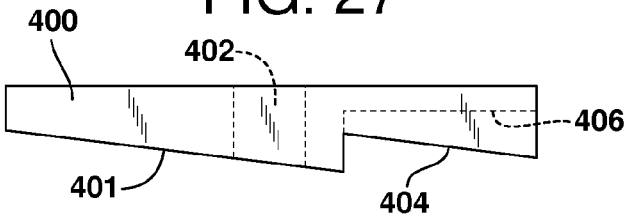
Figure 28:
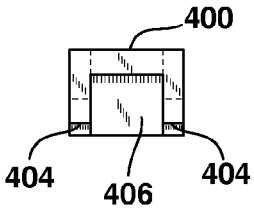
Figure 29:
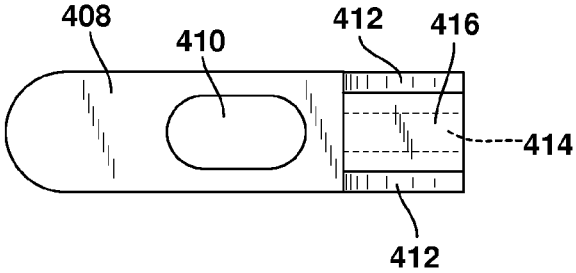
Figure 30:
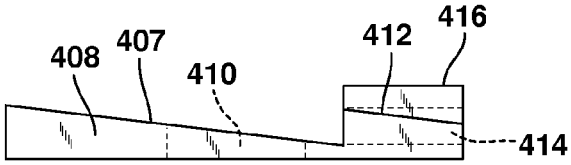
Figure 31:
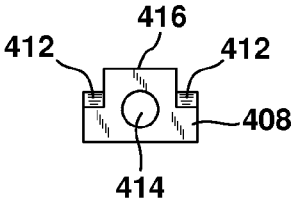
Figure 32:
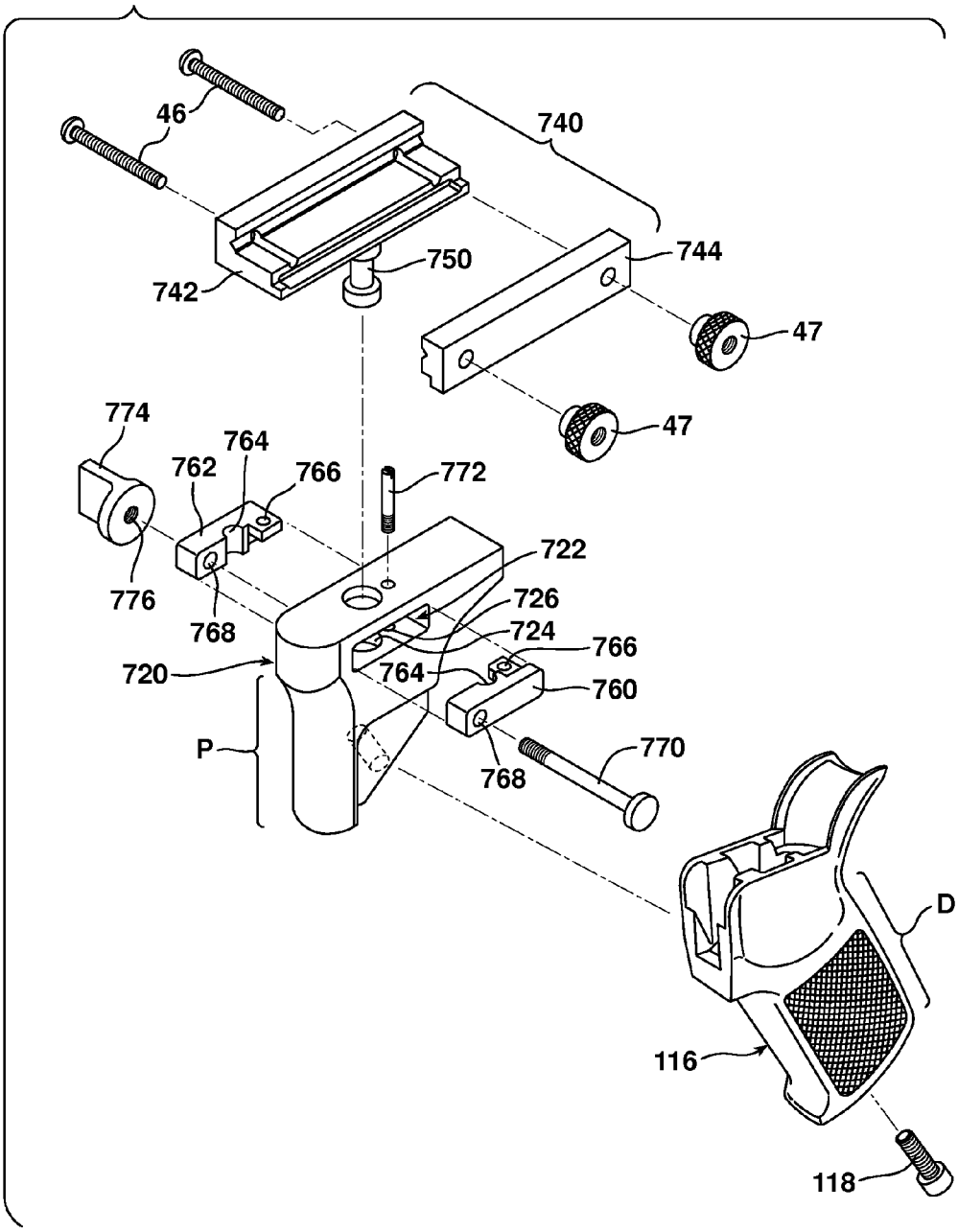
FIGS. 32-37
Figure 33:
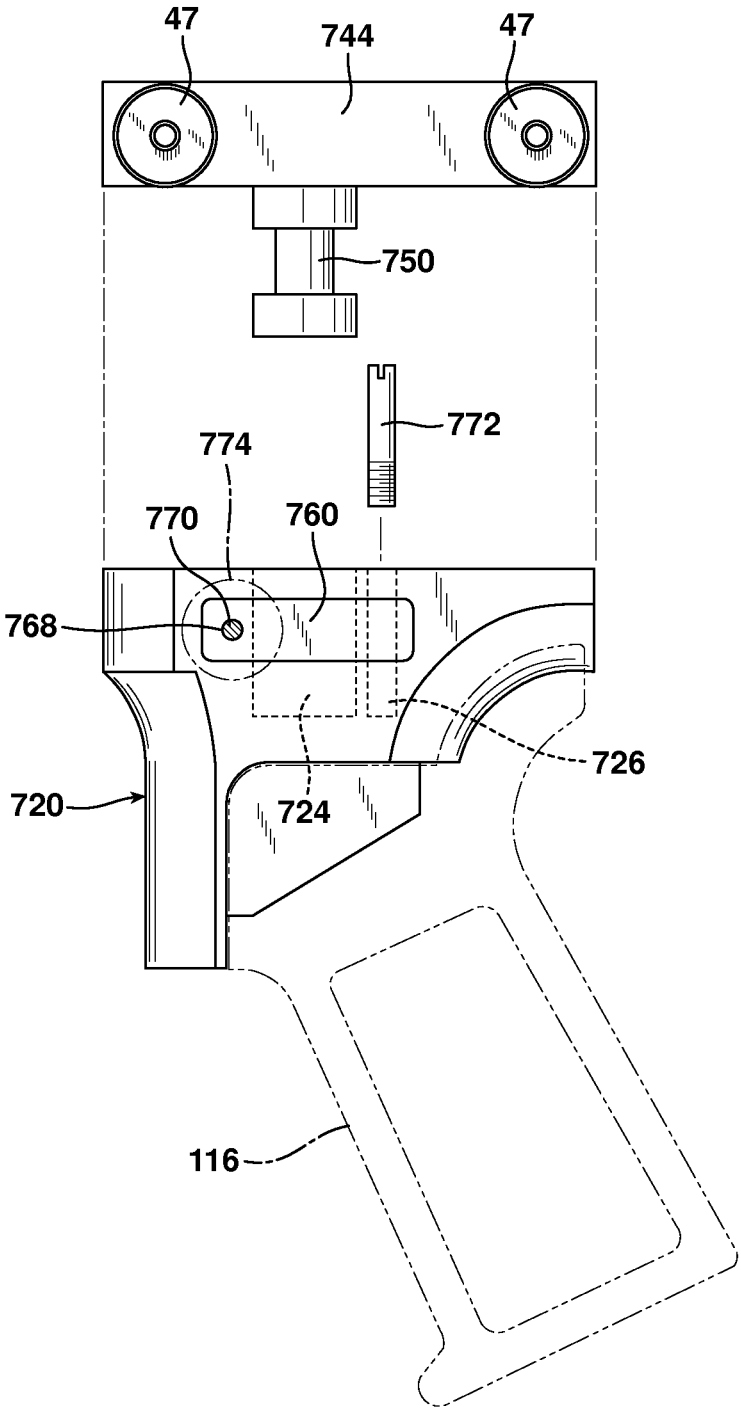
Figure 34:
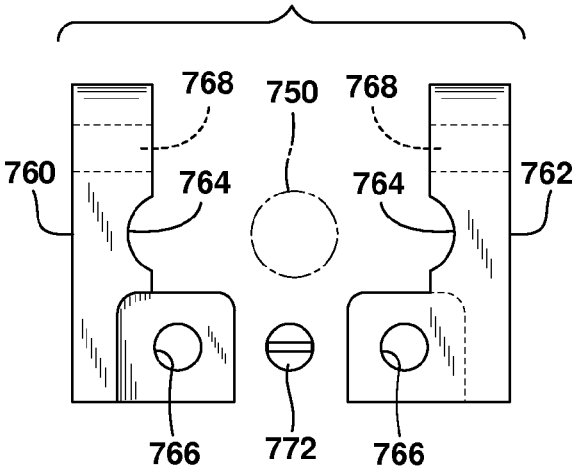
Figure 35:
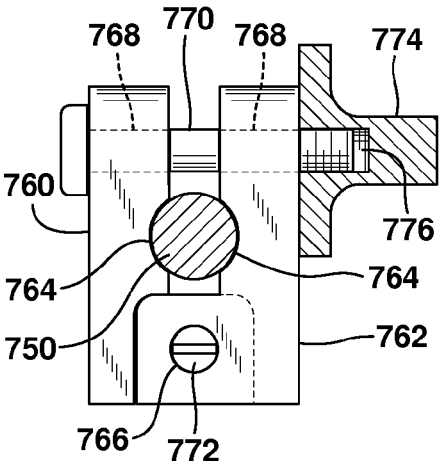
Figure 36:
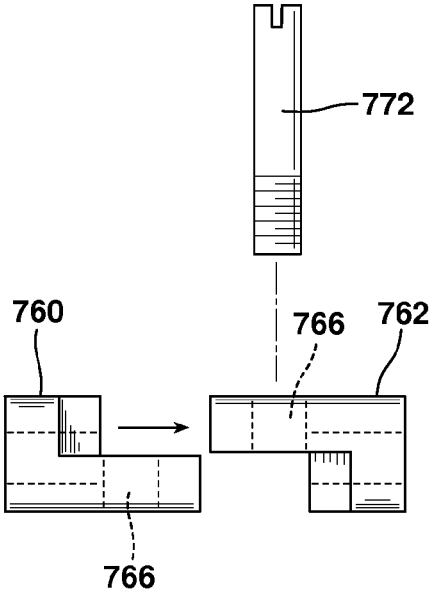
Figure 37:
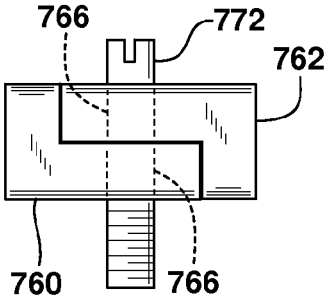

More specifically, referring FIGS. 23, 23A and 24A, rail mount 40 has a connecting bolt or screw 424 that passes through hole 402 in rail mount 40 to secure the lower portion of rail mount 40 to the proximal portion P of the handgrip. Referring to FIGS. 23 through 31, screw 424 passes through hole 402 in upper stationary wedge 400 and passes through slot 410 in lower adjustable wedge 408. Passing through at least one side of the enclosure is an anti-rotation pin 426 inserted in screw 424 that prevents the screw 424 from rotating and loosening the rail mount 40 from the handgrip.

Upper stationary wedge 400 is held in a fixed position by screw 424 passing through hole 402 therein. Upper stationary wedge 400 has a channel 406 in the rear ramp, i.e., the end closest to screw 418 and knob 422, and a wedge surface 401. Lower adjustable wedge 408, which is slidably mounted in the enclosure, has a slot 410 that screw 424 passes through, a guide 416 that slidably mates with channel 406 in the upper stationary wedge 400, and a wedge surface 407 that slidably mates with wedge surface 401 of upper stationary wedge 400. Adjustment screw 418 passes through the rear wall of the proximal portion P of the handgrip, being positioned therein by snap ring 420, and threads into threaded hole 414 in the proximal end of lower adjustable wedge 408. Lower adjustable wedge 408 with slot 410 therein, slidably mates with screw 424 and upper edge 400, upper stationary wedge 400 being held in a fixed position by screw 424.

In FIG. 24 the wedges 400 and 408 are in a loosened positioned permitting the user to change the pivot angle of the handgrip, i.e., change the pivot angle between the Vertical Plane VP and the Central Axis CA. The handgrip is pivoted to the selected pivot angle. In this embodiment there are no predetermined pivot angles but the pivot angle is set to any desired angle. In order to lock the pivot angle the knob 422 is turned clockwise. This draws or pulls the lower adjustable wedge 408 toward the right, causing the upper stationary wedge 400 to be forced against the lower portion of the rail mount 40 locking the mount 40 to the top of proximal portion P of the handgrip.

Elements in Embodiment IV:

CA Central Axis
VP Vertical Plane
P Proximal portion of handgrip 116
40 rail mount
44 clamping jaw of rail mount 40
46 tightening screws for connecting and stationary jaw 42 and clamping jaw 44
47 knurled locking nuts for tightening screws 46
400 upper stationary wedge
401 wedge surface of 400
402 opening for rail mount connecting bolt 424
404 rear ramp of wedge
406 channel between rear ramps of wedge
407 wedge surface of 408
408 lower adjustable wedge
410 slot for adjustment of wedges
412 rear ramps of lower adjustable wedge 408
414 threaded hole for adjustment screw 418
416 guide between ramps
418 lower wedge adjustment screw
420 snap ring for adjustment screw 418
422 knob for adjustment screw
424 rail mount connecting bolt
426 anti-rotation pin for bolt 424

Embodiment V

FIGS. 32-37

The Fifth embodiment, depicted in FIGS. 32-37, distinguishes itself from the previous embodiments in that an adjustment knob 774 located at the side of the proximal portion P of the handgrip 116 is turned to loosen or tighten a clamp mechanism about a frictional stud 750 to lock or unlock the lock means.

More specifically, referring FIG. 32-37 the lower portion of rail mount 740 has secured thereto one end of dumbbell shaped frictional stud 750 that is seated in receptacle 724 that is in the top of the proximal portion P of the handgrip 116. The other end (lower portion) of the frictional stud 750 pivotally mates with the bottom of receptacle 724. Surrounding the center of stud 750 in housing 722 are frictional clamps 760 and 762. On one set of the ends of clamps 760 and 762 are mating holes 766 through which pivot pin 772 passes. The pivot pin 772 is secured at one end in the floor of the enclosure and it the other end in the top of the housing 722. On the other ends of clamps 760 and 762 are mating holes 768 through which pinch bolt 770. One end of pinch bolt 770 has a fixed head and the other end is threaded to mate with threaded hole 776 in adjustment knob 774.

Thus, when the user desires to change the pivot angle of the handgrip 116, the adjustment handle 774 is turned to loosen the frictional clamps 760 and 762 from gripping the center of the frictional stud 750. This action permits the handgrip 720 and 116 to pivot to a selected pivot angle. In this embodiment there are no predetermined pivot angles but the pivot angle is set to any desired angle. Likewise, when the adjustment handle 774 is turned to tighten the frictional clamps 760 and 762 to frictionally grip the center of the frictional stud 750 the handgrip 720 and 116 are locked at the selected pivot angle.

Elements in Embodiment V:

CA Central Axis
VP Vertical Plane
P Proximal portion of handgrip 116
D distal portion of handgrip 116
720 handgrip apparatus
722 housing space for clamp 760, 762
724 cylindrical receptacle for frictional stud 750
726 hole for pivot pin 772
740 rail mount
744 clamping jaw of rail mount 740
750 frictional stud
760 left clamp for frictional stud 50
762 right clamp for frictional stud 52
764 cylindrical relief in clamp portions 760, 762 for clamping stud 750
766 mating holes in one set of ends of clamps 760, 762
768 holes through clamp portions 760, 762 for pinch bolt 770
770 pinch bolt
772 pivot pin
774 adjustment knob
776 threaded hole in adjustment knob 774 mates with pinch bolt 770

Embodiment VI

FIGS. 38-46

The Sixth embodiment, depicted in FIGS. 38-46, distinguishes itself from the previous embodiments in that a tension adjustment wheel 872 located in a housing 822 at the top of the proximal portion P of the handgrip 116 is turned to loosen or tighten the rail mount 840 to the proximal portion P of the handgrip 116.

Figure 38:
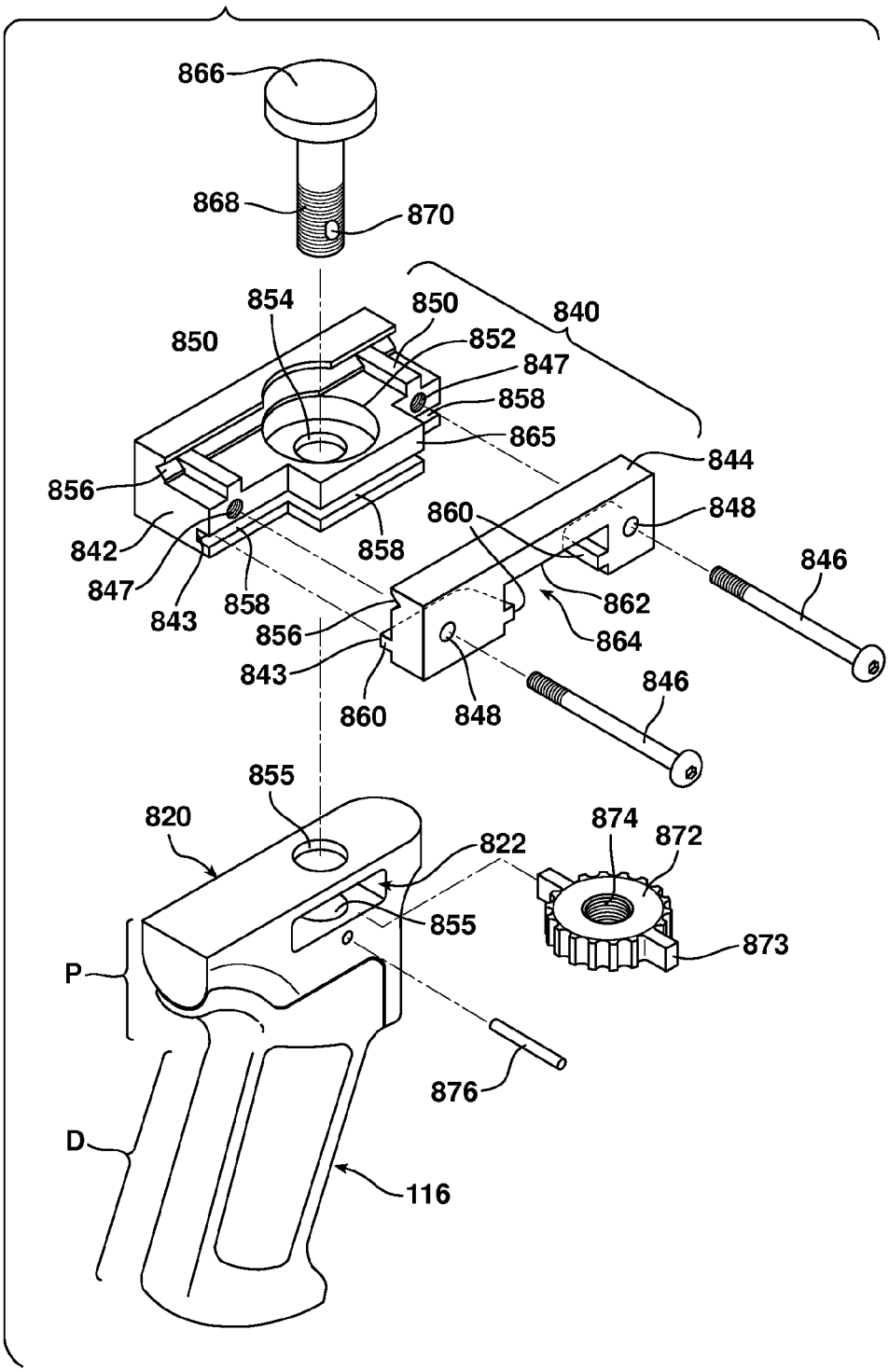
FIGS. 38-46
Figure 41:
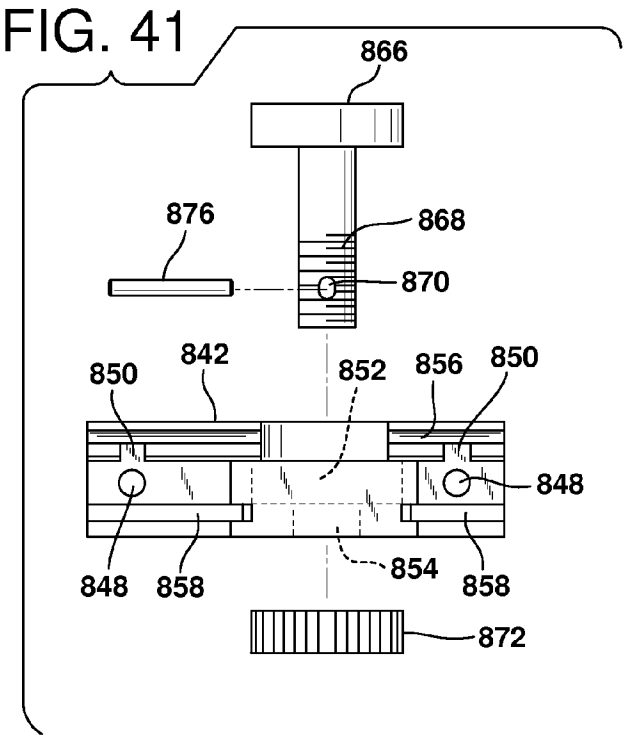
Figure 39:
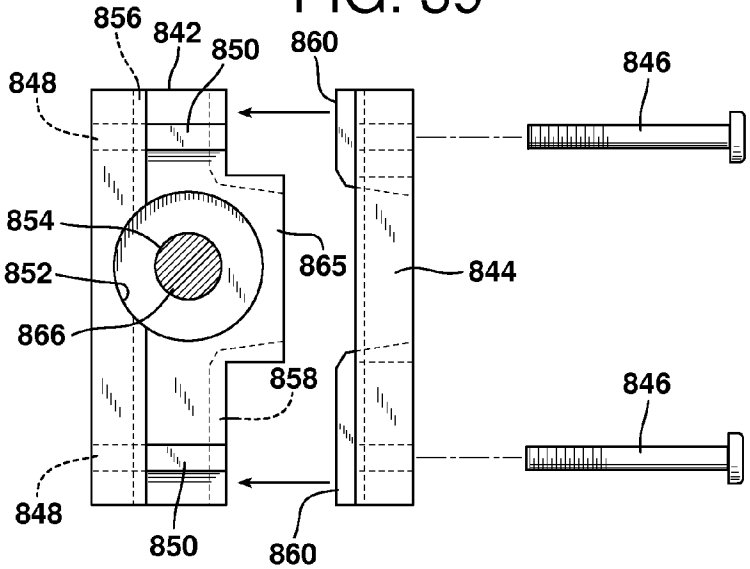
Figure 40:
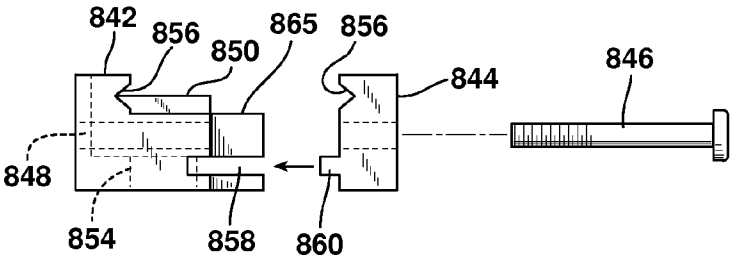
Figure 42:
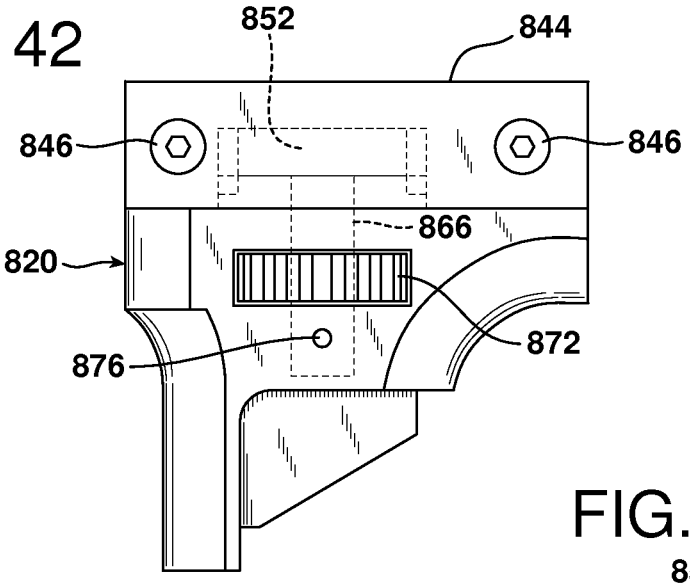
Figure 44:
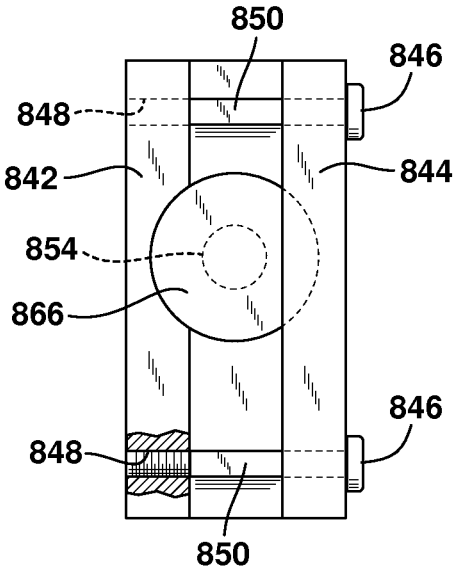
Figure 43:
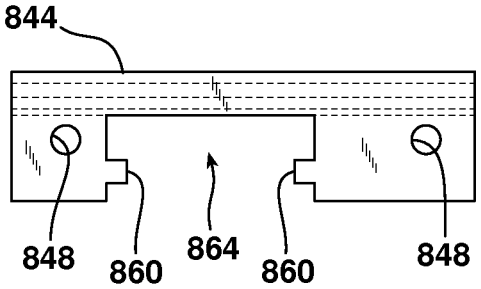
Figure 45:
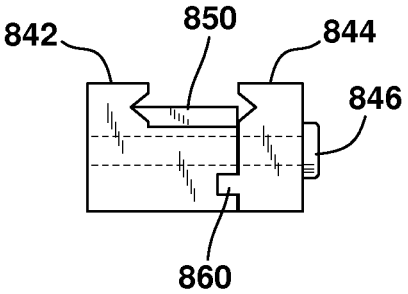
Figure 46:
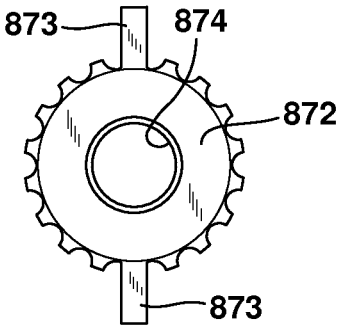

Referring for example to FIG. 38, the handgrip apparatus includes an elongated rail mount 840. In general, the rail mount 840 has an upper portion that removably engages the rail (not shown). The upper portion of the rail mount 840 includes a stationary jaw 842 and a clamping jaw 844. The jaws 842, 844 mate along interlocking surfaces 843, e.g., tongue and groove, when the jaws 842, 844 are pressed together. Two tightening screws 846 pass through the clamping jaw 844 and threadably mate with holes 847. Tightening the two screws 846 tightens the jaws 842, 844 into direct engagement with each other along surfaces 43 formed by alignment groove 858 mating with alignment rib 860 and tightens V-grooves 856 with the Picatinny rail (not shown). The V-grooves 856 lock the mount 840 onto the rail to prevent the removal of the handgrip apparatus from the rail.

More specifically, referring FIG. 38-46 a tension head 866 is mounted on a threaded shank 868, e.g., a bolt. The threaded shank 868 mates with hole 854 in the lower portion of rail mount 840 and holes 855 in the proximal portion P of the handgrip 820. The tension head 866 mates into receptacle 852 in the lower portion of the rail mount 840. On the distal end of the threaded shank 868 is hole 870 which receives anti-rotation pin 876. Threadably engaged with threaded shank 868 is tension adjustment wheel 872. The adjustment wheel 872 has a hole 874 with threads therein that mate with the threads on shank 868 and also has on the periphery thereof tabs 873 thereon for gripping the wheel 872 to tighten or loosen the wheel onto the shank 868. The wheel 872 fits into housing 822 in the proximal portion P of the handrip 820 with the tabs 873 protruding therefrom so that the wheel 872 may be loosened or tightened. The anti-rotation pin 876 passes through the proximal portion P of the handrip and the hole 870 in shank 868 to secure the shank 868 from rotation.

Thus, when the user desires to change the pivot angle of the handgrip 820, the adjustment wheel 872 is turned in a direction that raises shank 868 so that the tension head 866 does not secure the rail mount 840 to the proximal portion P of the handgrip 820. This action permits the handgrip 820 and 116 to pivot to a selected pivot angle. In this embodiment there are no predetermined pivot angles but the pivot angle is set to any desired angle. Likewise, when the adjustment wheel 872 is turned in the opposite direction the shank 868 is lowered so that the tension head 866 secures the rail mount 840 to the proximal portion P of the handgrip 820 at the selected pivot angle.

Elements in Embodiment VI

P Proximal portion of handgrip 116
D distal portion of handgrip 116
820 handgrip apparatus
822 housing for tension adjustment wheel 872
840 rail mount
842 stationary jaw of rail mount 840
843 interlocking surfaces of jaws 842, 844
844 clamping jaw of rail mount 840
846 screws for connecting and stationary jaw 842 and clamping jaw 844
847 threaded holes for screws 846
848 screw holes for screws 846
850 locater lugs for positioning rail mount 840 on Pacatinny Rail
852 receptacle for tension wheel 866
854 hole for shank 868
855 hole in proximal portion of handgrip
856 V-Grooves mate with Picatinny Rail grooves
858 alignment groove mates with alignment rib 860
860 alignment rib mates with alignment groove 858
862 bridge for clamping jaw 844
864 opening for jaw extension 865
865 jaw extension mates with opening 864
866 tension head
868 threaded shank of tension wheel 866
870 hole for anti-rotation pin 876
872 tension adjustment wheel
873 tabs on adjustment wheel 873
874 threaded hole for threaded shank 868
876 anti-rotation pin The foregoing constitutes a description of specific embodiments showing how the invention may be applied and put into use. These embodiments are only exemplary. The invention in its broadest, and more specific aspects, is further described and defined in the claims which now follow.

The invention claimed is:

1. A handgrip apparatus for mounting on a forward portion of a firearm, the firearm having a barrel having a central axis, the handgrip apparatus comprising:

a. a mount having an upper portion and a lower portion, the upper portion including a clamp means for removably engaging the forward portion of the firearm;

b. a handgrip apparatus having an upper portion and a lower portion;

c. a handgrip held by a shooter removably mounted to the lower portion of the handgrip apparatus by a retaining member passing through an aperture in the handgrip, the retaining member removably retained in an aperture in the lower portion of the handgrip apparatus, the handgrip being substantially symmetrical about a vertical plane passing through the handgrip and at least a majority of the handgrip extends below the lower portion of the handgrip apparatus, and wherein the handgrip is offset at an offset angle in the vertical plane from the handgrip apparatus;

d. a stud mounted to the lower portion of the mount and to the upper portion of the handgrip apparatus, the stud surrounded by a clamp for frictionally engaging and disengaging the stud, the stud pivotally connecting the lower portion of the mount to the handgrip apparatus to permit the pivoting of the vertical plane of the handgrip apparatus about a pivot axis substantially perpendicular to the central axis of the barrel and to varying pivot angles relative to the central axis of the barrel;

e. an adjustment knob mounted on the handgrip apparatus above the handgrip for adjusting such clamp, wherein when the adjustment knob is turned in one direction the clamp surrounding the stud engages the stud to lock the vertical plane of the handgrip apparatus at one pivot angle relative to the central axis, and when turned in the other direction the clamp surrounding the stud disengages from the stud to unlock the stud for pivoting the vertical plane of the handgrip apparatus to another pivot angle relative to the central axis for locking the stud at such another pivot angle relative to the central axis;

wherein the handgrip can be selectively removed from and mounted to the handgrip apparatus and selectively switched out for aesthetic or functional reasons.

* * * * *